US010829880B2

(12) United States Patent
Shu et al.

(10) Patent No.: US 10,829,880 B2
(45) Date of Patent: Nov. 10, 2020

(54) PORTABLE WASHING UNIT

(71) Applicants: AQUA CO., LTD, Tokyo (JP); QINGDAO HAIER WASHING MACHINE CO., LTD., Qingdao, Shandong (CN)

(72) Inventors: Hai Shu, Qingdao (CN); Peishi Lv, Qingdao (CN); Masahiro Fujiwara, Tokyo (JP); Masakazu Yamamoto, Tokyo (JP); Masaru Noro, Tokyo (JP); Zhengtao Wang, Qingdao (CN)

(73) Assignees: AQUA CO., LTD., Tokyo (JP); QINGDAO HAIER WASHING MACHINE CO., LTD., Qingdao (CN)

( * ) Notice: Subject to any disclaimer, the term of this patent is extended or adjusted under 35 U.S.C. 154(b) by 131 days.

(21) Appl. No.: 15/750,822

(22) PCT Filed: Aug. 8, 2016

(86) PCT No.: PCT/CN2016/094008

§ 371 (c)(1),
(2) Date: Feb. 6, 2018

(87) PCT Pub. No.: WO2017/025011

PCT Pub. Date: Feb. 16, 2017

(65) Prior Publication Data

US 2018/0245258 A1 Aug. 30, 2018

(30) Foreign Application Priority Data

Aug. 7, 2015 (JP) ..... 2015-157297

(51) Int. Cl.
*D06F 9/00* (2006.01)
*A47L 11/40* (2006.01)
(Continued)

(52) U.S. Cl.
CPC ..... *D06F 9/00* (2013.01); *A47L 11/4005* (2013.01); *A47L 11/4069* (2013.01);
(Continued)

(58) Field of Classification Search
None
See application file for complete search history.

(56) References Cited

U.S. PATENT DOCUMENTS 4,435,964 A * 3/1984 Misawa ..... A47L 23/02 15/33
5,749,248 A * 5/1998 Kim ..... D06F 17/10 68/27
5,881,418 A 3/1999 Enoch

FOREIGN PATENT DOCUMENTS

CN 2399992 10/2000
CN 201135223 10/2008
(Continued)

OTHER PUBLICATIONS

International Application No. PCT/CN2016/094008, International Search Report, dated Oct. 24, 2016.

*Primary Examiner* — Cristi J Tate-Sims
(74) *Attorney, Agent, or Firm* — Greenberg Traurig

(57) ABSTRACT

A portable washing unit, which is capable of automatically carrying out various types of washing treatments respectively. A portable washing unit is provided with a driving unit, which is configured to be drivable in a state where an accessory at least capable of executing a washing treatment and serving as a washing mechanism is connected, and is attachable and detachable for various accessories capable of performing washing-related treatments.

7 Claims, 16 Drawing Sheets

(51) Int. Cl.

| | |
|---|---|
| ***A47L 13/12*** | (2006.01) |
| ***A47L 25/00*** | (2006.01) |
| ***D06F 43/00*** | (2006.01) |
| ***A47L 13/26*** | (2006.01) |
| ***D06F 15/00*** | (2006.01) |
| ***D06F 19/00*** | (2006.01) |
| *D06F 5/00* | (2006.01) |
| *D06F 39/02* | (2006.01) |
| *D06F 7/04* | (2006.01) |

(52) U.S. Cl.

CPC ..... *A47L 11/4075* (2013.01); *A47L 11/4083* (2013.01); *A47L 13/12* (2013.01); *A47L 13/26* (2013.01); *A47L 25/00* (2013.01); *D06F 15/00* (2013.01); *D06F 19/00* (2013.01); *D06F 43/002* (2013.01); *D06F 5/00* (2013.01); *D06F 7/04* (2013.01); *D06F 39/024* (2013.01)

(56) References Cited

FOREIGN PATENT DOCUMENTS

| | | |
|---|---|---|
| CN | 201208027 | 3/2009 |
| JP | 2001275753 | 10/2001 |
| KR | 20060061223 | 6/2006 |

* cited by examiner

PORTABLE WASHING UNIT

The present application is a national phase application under 35 U.S.C. § 371 of International Patent Application PCT/CN2016/094008, filed on Aug. 8, 2016, which claims priority to Japanese Patent Application No. 2015-157297, filed on Aug. 7, 2015, the entire disclosures of which applications are hereby incorporated herein by reference.

TECHNICAL FIELD

The present application relates to a portable washing unit, which is configured to replace accessories capable of performing different washing treatments respectively.

BACKGROUND

In the case that dirt is partially attached to the cloth product to form stains, compared with the overall washing of the cloth product, it is feasible to only wash the stain portion from aspects of the decontamination effect and the operation efficiency. As a device capable of partially washing the cloth product, a stain removing system of non-patent literature 1 can be exemplified.

The stain removing system of the non-patent literature 1 is composed of a bottle body for accommodating detergent, and an absorbing sheet. A pore for supplying the detergent is formed in the top of the bottle body. The stain removing system can beat the stain portion with the top of the bottle body in such a state that the absorbing sheet is abutted against the bottom. The detergent is supplied to the stain portion by using the beating action. The supplied detergent is penetrated into the cloth product, and is absorbed into the absorbing sheet together with the dirt constituting the stain portion.

However, such a stain removing system of the non-patent literature 1 requires a hand holding the bottle body to move up and down rapidly, so a problem of hand fatigue is present. In addition, the stain removing system of the non-patent literature 1 merely can remove the stain, and its utilization range is very limited.

On the other hand, a patent literature 1 discloses a stain removal device which can spray a solvent to the stain portion of clothes by pressing a switch and can remove the dirt from the stain portion of the clothes together with the solvent through attraction generated by a negative pressure of a fan. Since the solvent can be automatically coated to the clothes and the coated solvent can be automatically attracted (removed) by the stain removal device, the beating force does not need to be repeatedly applied to the stain portion manually, and the hand fatigue resulted from rapid movement of the hand does not happen.

However, since the solution disclosed in the patent literature 1 is an integration of a mechanism for spraying the solvent and the attracting mechanism, it is considered that the components such as a driving mechanism are necessary in each of the mechanisms. Thus, as the number of components is increased, the device is easy to become large and is difficult to be produced into a portable structure.

CURRENT TECHNICAL LITERATURE

Patent Literature

Patent Literature 1: Japanese Laid-Open Patent Publication No. 2003-996

Non-Patent Literature

Non-patent Literature 1: Internet <URL:http//www.lion-.cojp/ja/seihin/brand/025/06.htm>

SUMMARY

Problems to be Solved by the Disclosure

The purpose of the present disclosure is to effectively solve such problems, and can provide a portable washing unit, which is capable of performing different washing treatments.

Solutions for Solving the Problems

In view of the above problems, the present disclosure proposes the following solutions.

Namely, the portable washing unit of the present disclosure comprises a washing unit body, which is configured to be drivable in a state where a washing mechanism at least capable of executing a washing treatment is connected, and is attachable and detachable for various accessories capable of performing washing-related treatments.

Specifically, the characteristic of the present disclosure lies in that the washing mechanism is constituted as an accessory that is attachable to and detachable from the washing unit body, which is a driving unit having the following parts: a motor, which is driven rotationally by means of a power supply, a driving side body housing, which is provided therein with the motor, and is formed with a driving side attaching-detaching portion that is connectable to the accessories, and a rotation transmission portion, which is capable of transmitting a rotational force of the motor to the accessories.

More specifically, it can be considered in the present disclosure that, as an accessory, an accessory having following portions is capable of being attached and detached: a rotation input portion, which is engageable with the rotation transmission portion; a transmission mechanism, which increases or decreases a rotational speed of a rotational force input from the rotation input portion, and an auxiliary side body housing, which is provided therein with the rotation input portion and the transmission mechanism, and is formed with an auxiliary side attaching-detaching portion that is connectable to the driving side attaching-detaching portion.

Particularly, the transmission mechanism of the present disclosure may be a planetary gear mechanism, which comprises a sun gear that is connected to the rotation input portion, a plurality of planetary gears that rotate around the sun gear, a planetary carrier that is connected to a center of each of rotation shafts of the planetary gears, and a ring gear, which is arranged around the planetary carrier.

Particularly, in the present disclosure, as an accessory, a beating-type accessory is capable of being attached and detached, and the beating-type accessory comprises: a motion direction conversion mechanism, which converts a rotational motion input by the rotation input portion into a linear motion, a head portion, which is formed with a beating surface, and vibrates in an axis direction substantially orthogonal to the beating surface via the linear motion converted by the motion direction conversion mechanism, a liquid accommodating portion for accommodating liquid, and a water supply path, which is formed from the liquid accommodating portion to the head portion. The motion direction conversion mechanism comprises a reference axis, which extends in the axial direction, an inclined surface inclined with respect to the axis direction and extends about the reference axis; and a linear direction moving portion, which is connected to the head portion, and relatively moves on the inclined surface and moves in the axis direction by means of a rotation of the reference axis.

In addition, in the present disclosure, as an accessory, a brush-type accessory is capable of being attached and detached, and the brush-type accessory includes a rotary brush that is connected to the rotation input portion by means of the transmission mechanism.

Alternatively, the washing mechanism may comprise: a head portion, which is formed with a beating surface, a vibration portion, which enables the head portion to vibrate in an axis direction orthogonal to the beating surface by means of the driving of an electromagnetic actuator or a motor, a liquid accommodating portion for accommodating liquid, and a water supply path, which is formed from the liquid accommodating portion to the head portion. The washing unit body is a beating and washing unit, comprising: the washing mechanism, a power supply portion, which supplies power to the vibration portion, and a beating side body housing, which is provided therein with the washing mechanism and the power supply portion, and is formed with a beating side attaching-detaching portion that is connectable to the accessories and a connection portion capable of transmitting the power of the power supply portion to the accessories.

Moreover, the present disclosure is featured by a portable washing unit formed by the washing unit body and the accessories.

Effects of the Disclosure

The present disclosure described above can automatically perform a variety of washing treatments related to the washing by changing the types of the accessories mounted onto the washing unit body. Besides, since the present disclosure relates to an accessory manner, it can achieve the common use of the washing unit body. Thus, the present disclosure can carry out treatments besides the change of the washing manner and the cleaning related to the washing, and can reduce the number of the components to realize compactness to desirably serve as a portable washing device and a pre-washing machine for the traditional large washing machine.

Specifically, according to the present disclosure in which the washing unit body is a driving unit, the rotational force of the motor is transmitted to the accessory via the rotation transmission portion, and thus, the rotational force can be used for driving the accessory. Therefore, by changing the types of the accessories assembled by the driving side attaching-detaching portion, a variety of washing treatments can be performed automatically.

In addition, according to the present disclosure in which an accessory, capable of being attached and detached, of a transmission mechanism that can increase or reduce the rotational speed of the rotational force input by the rotation input portion, the rotational speed of the rotational force can be adjusted at the accessory side, and the rotational speed can be freely adjusted by each of the accessories.

Particularly, according to the present disclosure in which the transmission mechanism is a planetary gear mechanism, since the axial core of the transmission mechanism is substantially consistent with that of the auxiliary side body housing, the diameter of the auxiliary side body housing can be greatly reduced to realize miniaturization compared with the case where transmission mechanisms that have other structures and whose axial cores are biased relative to the auxiliary side body housing are used.

In particular, according to the present disclosure that is configured to attach and detach a beating-type accessory (a motion direction conversion mechanism that is capable of being attached and detached by a beating-type accessory has a reference axis, which extends in the axial direction, an inclined surface inclined with respect to the axis direction and extends about the reference axis, and a linear direction moving portion, which is connected to the head portion, relatively moves on the inclined surface and moves in the axis direction by means of a rotation of the reference axis), since the axial core of the motion direction conversion mechanism is enabled to be substantially consistent with the axis of the auxiliary side body housing, the present disclosure can greatly reduce the diameter of the auxiliary side body housing to realize miniaturization compared with the case where motion direction conversion mechanisms that have other structures and whose axial cores are biased relative to the auxiliary side body housing are used. Besides, the head portion vibrates while it is supplied with a liquid from the liquid accommodating portion to the beating surface of the head portion. Therefore, the action of beating the head portion to remove the object can be carried out automatically, and the operation of removing the stain can be carried out without moving the hands very quickly.

Further, according to the present disclosure that is configured to attach and detach brush-type accessories, articles that are rigid, such as the sports shoes and wallpapers also can be washed, thereby increasing the range of the washing objects.

Moreover, according to the present disclosure in which the washing unit body has a connection portion capable of transmitting the power of the power supply portion to the accessories and serves as a beating and washing unit, various washing-related treatments can be carried out by replacing the accessories that are electrically connected by the connection portion with other types of accessories besides the beating and washing with the use of the driving force applied to the linear direction of the electromagnetic actuator. In addition, a commonly used power supply portion is used to vibrate the head portion and the drive the accessory so as to inhibit the large scale of the device.

In addition, according to the present disclosure formed by the washing unit body and the accessories, a portable washing unit capable of automatically performing different washing treatments can be achieved.

A LIST OF REFERENCE NUMERALS

1 and 1': Portable driving unit (washing unit body); 3: Beating unit (beating-type accessory, washing mechanism); 5: Brush unit (brush-type accessory, washing mechanism); 11: Battery (power supply portion); 12: Motor; 13: Output shaft (rotation transmission portion); 14: Driving side body housing; 18*b*: Engagement recessed portion (driving side attaching-detaching portion); 34: Head portion; 34*c*: Beating surface; 35: Liquid accommodating portion; 36: Water supply path; 37: Auxiliary side body housing; 38: Engaging claw (auxiliary side attaching-detaching portion); 41: Input shaft (rotation input portion); 42: Planetary gear mechanism (transmission mechanism); 42*a*: First sun gear (sun gear); 42*b*: First planetary gear (planetary gear); 42*d*: First planetary carrier (planetary carrier); 42*e*: Ring gear component (ring gear); 43 and 143: Motion direction conversion mechanism; 43*a* and 143*a*: Reference axis; 43*b*1 and 143*b*1: Inclined surface; 43*f*2 and 143*g*: Linear direction moving portion; 50: Rotary brush; 90: USB connection portion (connection portion); 91: Impeller unit (accessory); 92: Brush unit (accessory); 100 and 110: Beating and washing unit (washing unit body); 133: Beating side body housing; 194: Beating side attaching-detaching portion; 200: Washing mechanism; 204: Vibration portion; 241: Electromagnetic actuator; X1-X9: Portable washing unit.

DETAILED DESCRIPTION

The first embodiment of the present disclosure will be described below in combination with drawings.

First Embodiment

Figure 1:
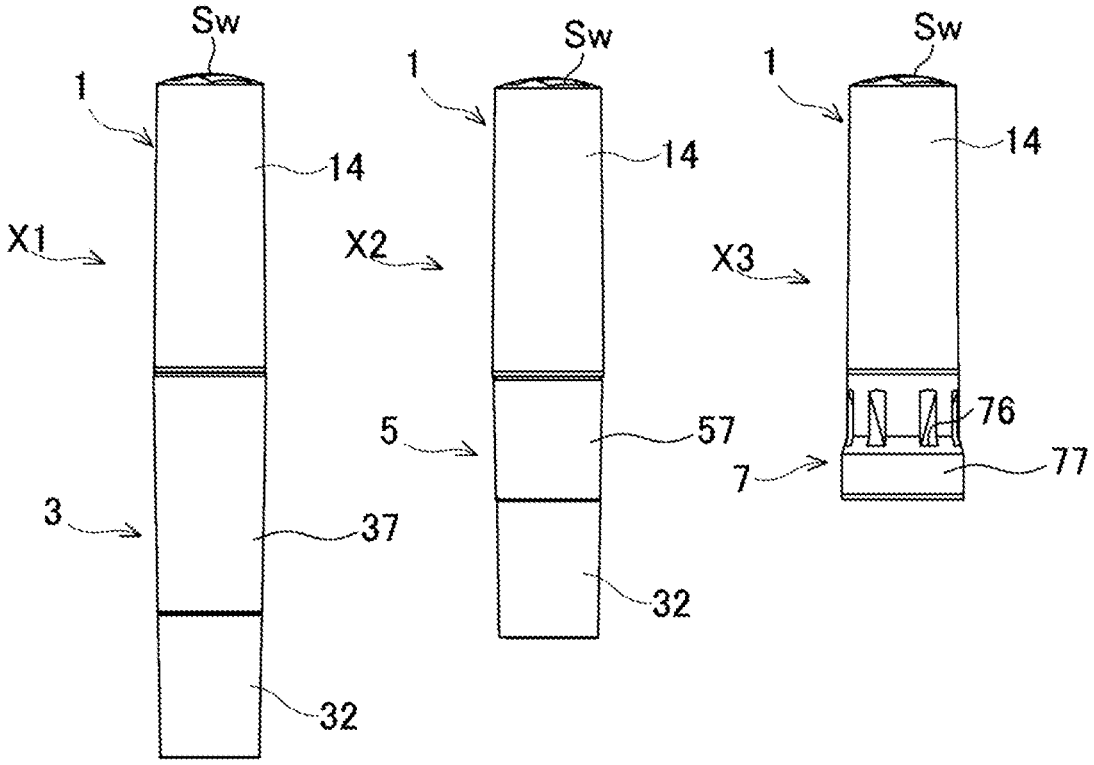
FIG. 1 is a front view of a driving unit of a portable washing machine in a first embodiment of the present disclosure in a state in which various types of accessories are mounted respectively.
Figure 2:
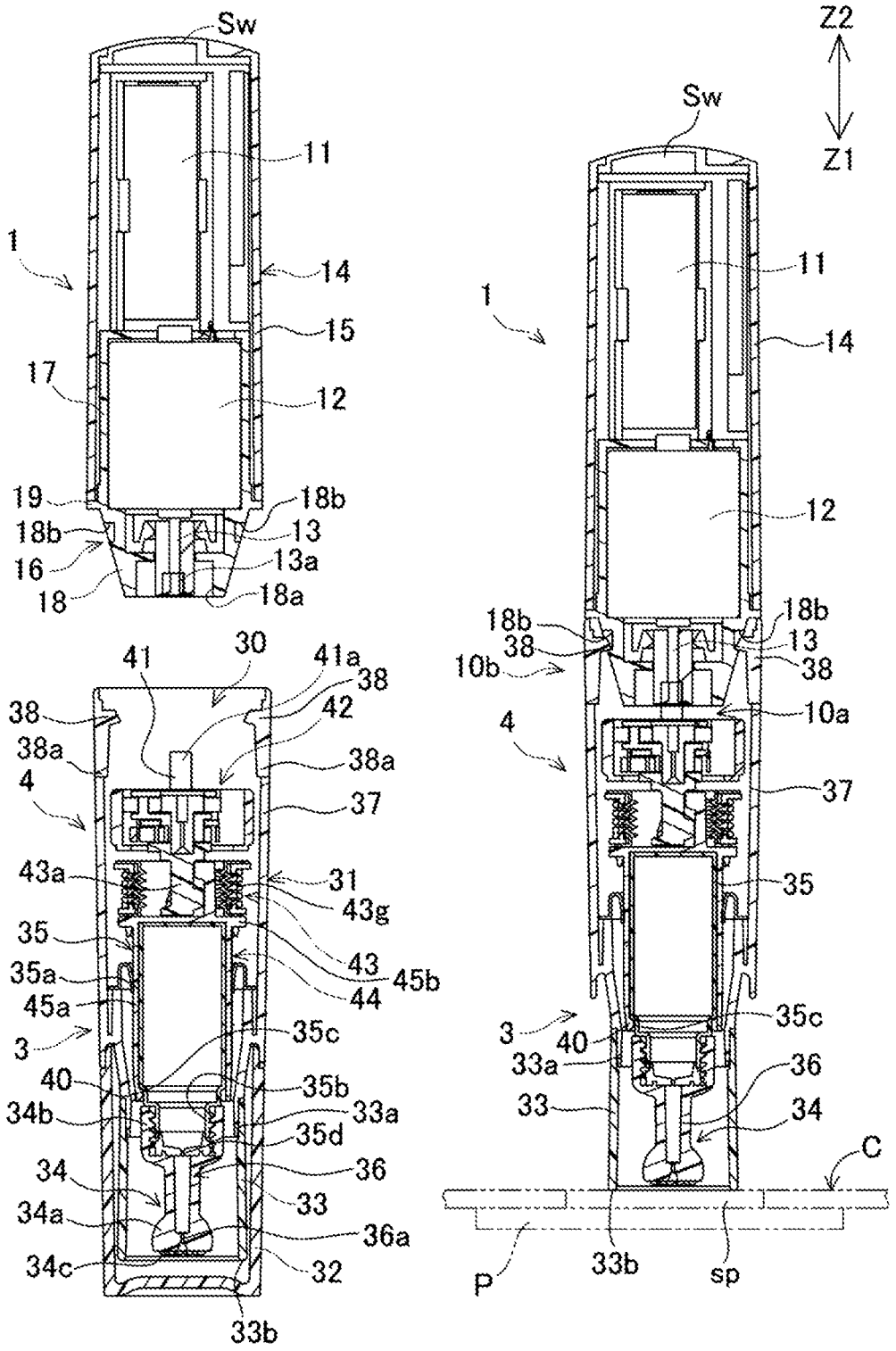
FIG. 2 is a longitudinal sectional view illustrating the same driving unit in a state where a beating unit as a beating-type accessory is combined.

FIG. 1 is a front view of a driving unit (hereinafter referred to as a "driving unit") of a portable washing machine in a first embodiment of the present disclosure in a state where accessories of washing mechanisms of types different from one another are mounted. FIG. 2 is a longitudinal sectional view illustrating a driving unit 1 in a state where a beating unit 3 as a beating-type accessory is combined.

As shown in FIG. 2, the driving unit 1, as the washing unit body, has a battery 11, a motor 12 and a driving side body housing 14.

The battery 11, as a power supply portion, is a rechargeable battery in the present embodiment, and is accommodated in the driving side body housing 14 by means of an unillustrated opening and closing cover formed at a portion of the driving side body housing 14.

The motor 12 is rotationally driven by the power supplied from the battery 11, and has an output shaft 13 as a rotation transmission portion that outputs its rotational force.

The driving side body housing 14 is provided therein with a battery 11 and a motor 12, and is composed of a first housing 15 and a second housing 16 that have substantially cylindrical bottoms.

The second housing 16 includes a motor accommodating portion 17, which accommodates a motor 12, a positioning portion 19 that extends radially outward from one end of the motor accommodating portion 17, and an accessory insertion portion 18 that extends conically from the positioning portion 19. The motor accommodating portion 17 and the battery 11 are accommodated in the first housing 15. On the other hand, the accessory insertion portion 18 protrudes from the first housing 15 by abutting the positioning portion 19 against the top end of the first housing 15.

The accessory insertion portion 18 is hollow, and a connection end portion 13*a* of the output shaft 13 passing through the center of the accessory insertion portion 18 is located at the opening end portion 18 thereof. A non-illustrated polygonal (it is a hexagonal in the present embodiment) engagement hole for the insertion of a below-described input shaft 41 is formed at a connecting end portion 13*a*. At the side of the accessory insertion portion 18, a plurality of (two in the present embodiment) engagement recessed portions 18*b* is formed at equally divided positions in the circumferential direction. The engagement recessed portions 18*b* can be driving side attaching-detaching portions of the beating unit 3, the brush unit 5 and the impeller unit 7 shown in FIG. 1 as various accessories that perform different washing treatments.

In this way, in this embodiment, the washing mechanism that at least performs the washing treatment is configured as an accessory that is attachable to and detachable from the washing unit body, i.e. the driving unit 1. The driving unit 1 is configured to attach and detach a beating unit 3, a brush unit 5 and an impeller unit 7 as various types of accessories capable of carrying out different washing treatments, and it is equipped with a motor 12 that is rotationally driven by the power supply, a driving side body housing 14, a built-in motor 12, which is formed with an engagement recessed portion 18*b* of a driving side attaching-detaching portion connected to the units 3, 5 and 7, and an output shaft 13 that serves a rotation transmission portion that transmits the rotational force of the motor 12 to the units 3, 5 and 7.

When such a structure is adopted, the rotational force of the motor 12 is transmitted to the beating unit 3, the brush unit 5 or the impeller unit 7 that serves as the accessory via the output shaft 13, and thus, the rotational force can be utilized to drive the units 3, 5 and 7. Therefore, by changing the types of the impeller unit 7 and the units 3 and 5 mounted via the engagement recessed portion 18*b*, various types of washing treatments can be automatically performed. In addition, since the present disclosure relates to an accessory manner to realize common use of the driving mechanism, it can carry out the treatments besides the change of the washing manner and the cleaning related to the washing. The present disclosure can reduce the number of the components to realize compactness to serve as a portable washing device and a pre-washing machine for the traditional large washing machine.

As shown in FIG. 2, the beating unit 3 has a device body 31, a head portion 34, a liquid accommodating portion 35, a water supply path 36, a vibration portion 4, and a cylindrical auxiliary side body housing 37 that is provided with the above components therein.

The head portion 34 has a beating portion 34*a* and a bottle body connection portion 34*b*. The beating portion 34*a* is a member that has a beating surface 34*c* having a substantially semicircular (more specifically, slightly close to a circle compared to a semicircle) cross section. The axis of such a head portion 34 substantially coincides with the axis of the auxiliary side body housing 37.

The bottle body connection portion 34*b* extends from the beating portion 34*a*, and is screwed to the head portion connection portion 35*b* of the liquid accommodating portion 35 described below. By removing the bottle body connection portion 34*b*, the liquid can be supplied into the liquid accommodating portion 35.

It should be note that, although the head portion 34 is made of a resin (for example, nylon) in the present embodiment, the material is not limited to the resin, and may be a metal (such as Stainless Used Steel: SUS) or the like.

The liquid accommodating portion 35 has a liquid storage portion 35*a* and a head portion connection portion 35*b*. The liquid storage 35*a* is a transparent or semitransparent hollow member that can contain a liquid. In addition, a part of the side surface of the liquid storage portion 35*a* is configured to be small in radial direction, and is formed with an engagement recessed portion 35*c* for the engagement of the engaging claw 40 described later. In such liquid storage portion 35*a*, a piston water supply hole 35*d* opened in a tapered shape toward the head portion 34 is formed. The liquid in the liquid storage portion 35*a* flows downward from the piston water supply hole 35*d* to pass through the water supply path 36 so as to be supplied to the beating surface 34*c*.

The head portion connection portion 35*b* is formed at the top end portion of the liquid storage portion 35*a*, and the body connection portion 34*b* is screwed.

Herein, the liquids that are specifically used can be water, common solvents such as a detergent mixture formed by a certain proportion of water and detergent, ethyl alcohol or gasoline, or special detergents for removing stains. In this embodiment, the liquid that is accommodated in the liquid storage portion 35*a* only can be the water.

The water supply path 36 shown in FIG. 2 supplies the liquid in the liquid accommodating portion 35 to the beating surface 34*c* of the head portion 34, and is formed by penetrating the head portion 34 from the liquid storage portion 35*a* to the beating surface 34*c*. At a portion of the water supply path 6, a small-diameter portion 36*a* is formed with a flow cross section smaller than that of the other portion.

The liquid dripped from the liquid storage portion 35*a* remains in such a water supply path 36. In a vibrating state of the head portion 34, a small amount of liquid in the water supply path 36 is discharged to the beating surface 34*c* of the head portion 34 with a stable flow rate successively (for example, 1 to 1.5 cc/min). On the other hand, in the non-vibrating state of the head portion 34, the dripping of liquid is prevented by the surface tension, especially in the small-diameter portion 36*a*.

The vibration portion 4 illustrated in FIG. 2 includes an input shaft 41, a planetary gear mechanism 42 as a transmission mechanism, a motion direction conversion mechanism 43, and a piston 44.

The top end portion 41*a* of the input shaft 41 is formed in a polygonal shape (specifically, it is a hexagon in the present embodiment). The input shaft 41 and the output shaft 13 are connected by inserting such a top end portion 41*a* into an unillustrated engagement hole of the output shaft 13. Thus, the rotational force of the motor 12 can be transmitted from the driving unit 1 to the beating unit 3.

The planetary gear mechanism 42 is a mechanism that decelerates the rotational speed of the rotational force input via the input shaft 41, and its specific structure will be described later. In addition, the input shaft 41 and the planetary gear mechanism 42 are also provided in the brush unit 5 shown in FIGS. 1 and 5.

The motion direction conversion mechanism 43 is connected to the input shaft 41, and converts the rotational movement input via the input shaft 41 into a linear movement. The motion direction conversion mechanism 43 is connected to the piston 44 that is provided therein with the liquid accommodating portion 35. When the motion direction conversion mechanism 43 outputs a linear motion, the piston 44, the liquid accommodating portion 35, and the head portion 34 integrally vibrate in the axis direction of the head portion 34.

Hereinafter, the axis direction of the head portion 34 may be referred to as a vibration direction. In addition, in the vibration direction, the direction in which the head portion 34 protrudes out of a device is referred to as a protruding direction Z1, and the opposite direction is referred to as a returning direction Z2.

The piston 44 moves in the axis direction of the head portion 34 while supporting the liquid accommodating portion 35 in a manner of positioning the beating surface 34*c* at the top end, and includes a bottle body holder 45*a* and a fixed portion 45*b*.

The body holding portion 45*a* is a substantially cylindrical member that opens toward the head portion 34. An engaging claw 40 that engages with the liquid accommodating portion 35 is provided at the side surface of the bottle body holding portion 45*a*. The engaging claws 40 are configured to be elastically deformable toward the outside of the bottle body holding portion 45*a* by the pressing from the attachable and detachable liquid accommodating portion 35. Therefore, the liquid accommodating portion 35 is inserted into the bottle body holding portion 45*a* to be engaged within the engaging claw 40 via the engagement recessed portion 35*c*, and is held by the head portion 34 and pulled by a predetermined force to the direction Z1 so that it can be pulled out from the body holding portion 45*a*.

The cover member 32 is detachable from the auxiliary side body housing 37, and is detached from the device body 31 shown in FIG. 2 at the time of performing a subsequent stain removal operation. In addition, the cover member 32 is attached to the device body 31 when the beating unit 3 is carried, thereby effectively preventing leakage outside the beating unit 3 and the impact on the head portion 34.

The protective cover 33 is a transparent and resin-made component that is inelastic and is substantially cylindrical, and it is detachably mounted to the top end portion of the auxiliary side body housing 37 via a rib 33*a* at a position where the side of the head portion 34 is surrounded. The length of such a protective cover 33 is set so that the operating end of the head portion 34 in the protruding direction Z1 slightly protrudes compared with the protruding end 33*b* of the protective cover 33.

By providing such a protective cover 33, the protective cover 33 can block the liquid scattered due to the vibration of the head portion 34 during the stain removing operation described later to prevent the liquid from being diffused over a wide range. Therefore, the area of the clothes C that is wetted can be reduced, and the clothes C can be put on immediately after the stain removal operation.

The auxiliary side body housing 37 is provided therein with a vibration portion 4 and a head portion 34, and it has an engaging claw 38 that is engageable with an engagement recessed portion 18*b* formed in the driving side unit 14 of the driving unit 1. With its base end side 38*a* being pressed, the engaging claw 38 can be elastically deformed to the radially outer side of the auxiliary side body housing 37. For the beating unit 3, when an accessory insertion portion 18 is inserted, the engaging claw 38 is pushed to the accessory insertion portion 18 to be deformed radially outward so as to be engaged with the engagement recessed portion 18*b* so that the beating unit 3 is mounted to the driving unit 1. On the other hand, the beating unit 3 is pressed at the base end side 38*a* of the engaging claw 38 to be pulled towards the protruding direction Z1 in a state of being elastically deformed radially outward so as to be removed from the driving unit 1.

The diameter of such an auxiliary side body housing 37 in the return direction Z2 is configured to be substantially equal to the diameter of the first housing 15 of the driving unit 1. In this regard, the brush unit 5 and the auxiliary side body housing 37 owned by the impeller unit 7 relate to the same case, and the connection condition of the output shaft 13 and the input shaft 41 also relates to the same case. The brush unit 5 and the impeller unit 7 are mounted inside the driving unit 1 in the same mounting conditions as those of the beating unit 3.

As described above, the driving unit 1 is configured to be an accessory capable of being attached and detached by the beating unit 3 and the brush unit 5. The accessory comprises an input shaft 41 as a rotational connection portion that is engageable with the output shaft 13, a planetary gear mechanism 42 that reduces the rotational force of the rotational speed input via the input shaft 41, and an auxiliary side body housing 37, which is provided therein with the input shaft 41 and the planetary gear mechanism 42, and is formed with the engaging claw 38 that is connected to the engagement recessed portion 18*b* and serves as an auxiliary attaching-detaching portion. It is assumed that the planetary gear mechanism 42 is provided at the side of the driving unit 1, and then, all the units 3 and 5 are driven at the same speed. However, when the planetary gear mechanism 42 is provided at each of the sides of the units 3, 5 and 7, the speeds at the accessories 3, 5 and 7 can be adjusted freely.

Such a driving unit 1 and the beating unit 3 are hand-held devices capable of partially washing the clothes C as a stain removal target. When the stain removing operation is performed, the beating unit 3 is inserted into the driving unit 1, the top end of the auxiliary side body housing 37 abuts the positioning portion 19 of the driving unit 1, and the beating unit 3 is mounted inside the driving unit 1 by connecting the output shaft 13 to the input shaft 41. Besides, an absorbent pad P, as a pad, abuts under the stain portion sp of the clothes C soiled by food stains or the like, and the stain removal detergent is directly applied to the stain portion sp of the Clothes C according to actual requirements. Then, the protruding end 31*a* of the protective cover 33 is pressed against the clothes C at a position where the beating surface 34*c* of the head portion 34 faces the stain portion sp.

When the power switch Sw is operated in this state, the motor 11 is rotationally driven by the power supplied from the battery 11, the rotational force transmitted via the output shaft 13 and the input shaft 41 is decelerated by the planetary gear mechanism 42 and is converted into a linear movement by the motion direction conversion mechanism 43. Then, the head portion 34 vibrates by the linear movement, and the beating force is applied to the stain portion sp by the beating surface 34*c*.

When the device body 31 is moved along the clothes C and such an operation is repeated, the liquid (the liquid merely can be water in the present embodiment) supplied to the stain portion sp and the detergent coated on the stain portion sp are dissolved to form the stain of the stain portion sp, and it is knocked out from the Clothes C and absorbed by the absorbent pad P. That is, the driving unit 1 to which the beating unit 3 is attached transfers the stains and the liquid of the Clothes C and the detergent to the absorbent pad P by applying the beating force so as to remove the stains.

It should be noted that the absorbent pad P is not particularly limited, and various articles can be used as long as the absorption speed of the liquid is high. For example, a product obtained after a kitchen paper towel is folded can be used.

Figure 3:
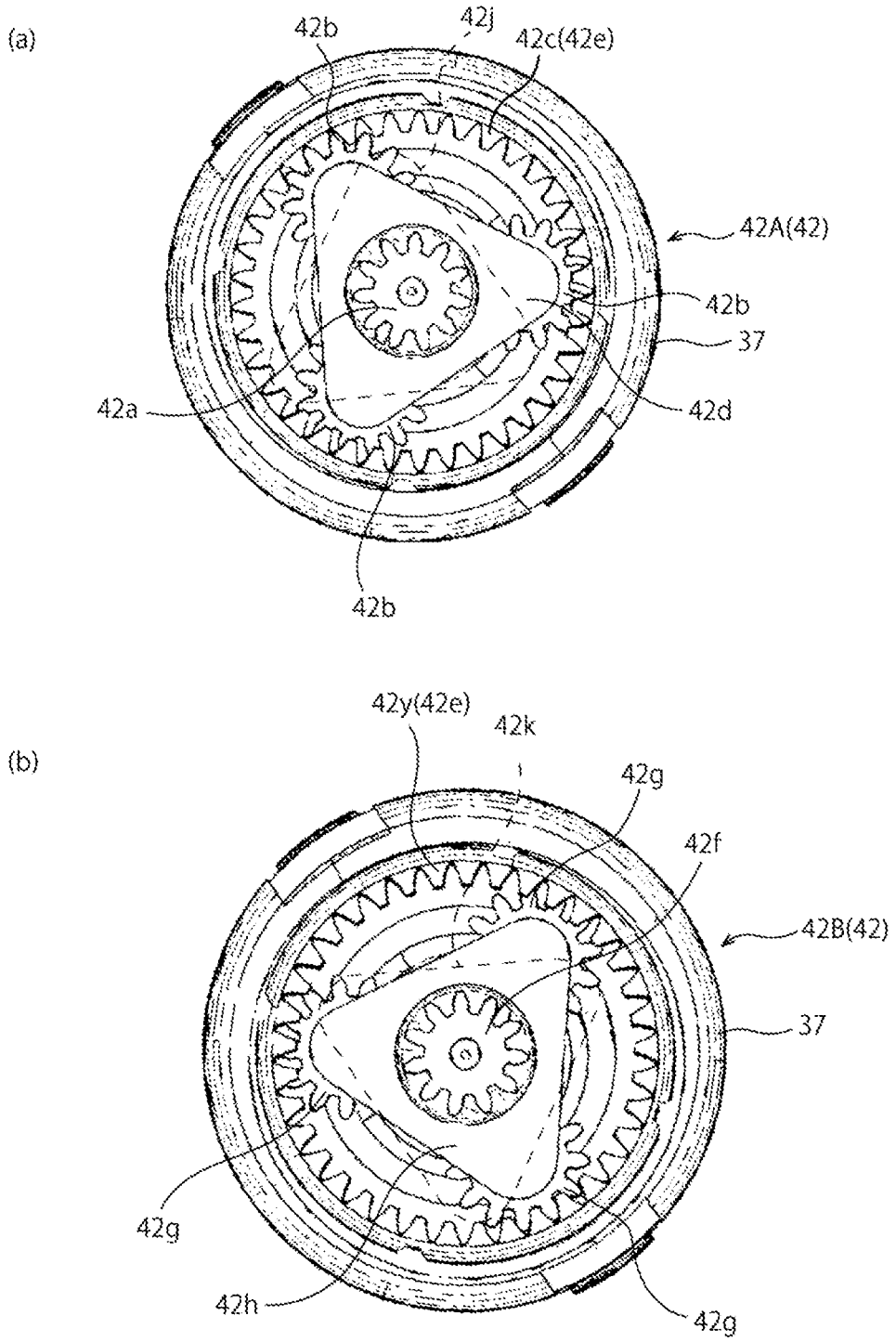
FIG. 3 is a top view illustrating a planetary gear mechanism included in the beating unit shown in FIG. 2.

Hereinafter, the structure of the planetary gear mechanism 42 will be described in detail with reference to FIG. 3. In the present embodiment, the planetary gear mechanism 42 is configured such that a first gear portion 42A and a second gear portion 42B are connected. FIG. 3(*a*) is a top view which represents the first gear portion 42A, and FIG. 3(*b*) is a top view which represents the second gear portion 42B.

The first gear portion 42A includes a first sun gear 42*a* connected to the input shaft 41, a plurality of (three in the present embodiment) first planetary gears 42*b* rotating around the first sun gear 42*a*, a first planetary carrier 42*c* provided closer to a side of the input shaft 41 than the first planetary gear 42*b* and connected to the center of each of the rotation shafts of the plurality of first planetary gears 42*b*, and a first ring gear portion 42*d* disposed around the first planetary gears 42*b*.

The second gear portion 42B includes a second sun gear 42*f* having the same structure as that of the first sun gear 42*a* except for being connected to the third planetary carrier 42*j* to be described later, a second planetary gear 42*g* having the same structure as that of the first planetary gear 42*b*, a second planetary carrier 42*h* provided to be closer to the first gear portion 42A than the second planetary gear 42*g* and having the same structure as that of the first planetary carrier 42*c*; and a second ring gear portion 42*y* that has the same structure as that of the first ring gear portion 42*d*. In the present embodiment, the first ring gear portion 42*d* and the second ring gear portion 42*y* are respectively formed on one ring gear component 42*e*.

In addition, a third planetary carrier 42*j* connected to the center of each of the rotation shafts of the first planetary gear 42*b* is provided between the first gear portion 42A and the second gear portion 42B. Further, a fourth planetary carrier 42*k* that has a connecting shaft 42*k*1 (see FIG. 4) connected to the center of each of the rotation shafts of the second planetary gear 42*g* is provided at a side closer to the motion direction conversion mechanism 43 (see FIG. 2) than the second gear portion 42B.

In such a planetary gear mechanism 42, the first sun gear 42*a* is rotated by the rotational force of the input shaft 41, and thus, a plurality of first planetary gears 42*b* rotates together with the first planetary carrier 42*c* within the first ring gear portion 42*d*. The rotation of the first planetary gear 42*b* is transmitted to the second sun gear 42*f* via the third planetary carrier 42*j*, and thus, the second planetary gear 42*g* and the second carrier 42*h* rotate within the second ring gear portion 42*y*. Further, the fourth planetary carrier 42*k* rotates due to the rotation of the second planetary gear 42*g*. The fourth planetary carrier 42*k* is connected to a motion direction conversion mechanism 43 to be described later.

As a transmission mechanism, the planetary gear mechanism 42 has the following parts: a first sun gear 42*a* connected to an input shaft 41 as a rotation input portion, a plurality of first planetary gears 42*b* wound around the periphery of the first sun gear 42*a*, a first planetary carrier 42*d* connected to the center of each of the rotation shafts of the first planetary gears 42*b*, and a ring gear component 42*e* disposed around the first planetary carrier 42*d*. Therefore, the axial core of the transmission mechanism can be substantially aligned with the axial core of the auxiliary side body housing 37, and compared with the case of using the transmission mechanisms having other structures and whose axes are biased relative to the auxiliary side body housing 37, the diameter of the auxiliary side body housing 37 can be reduced significantly so as to achieve the compactness.

Figure 4:
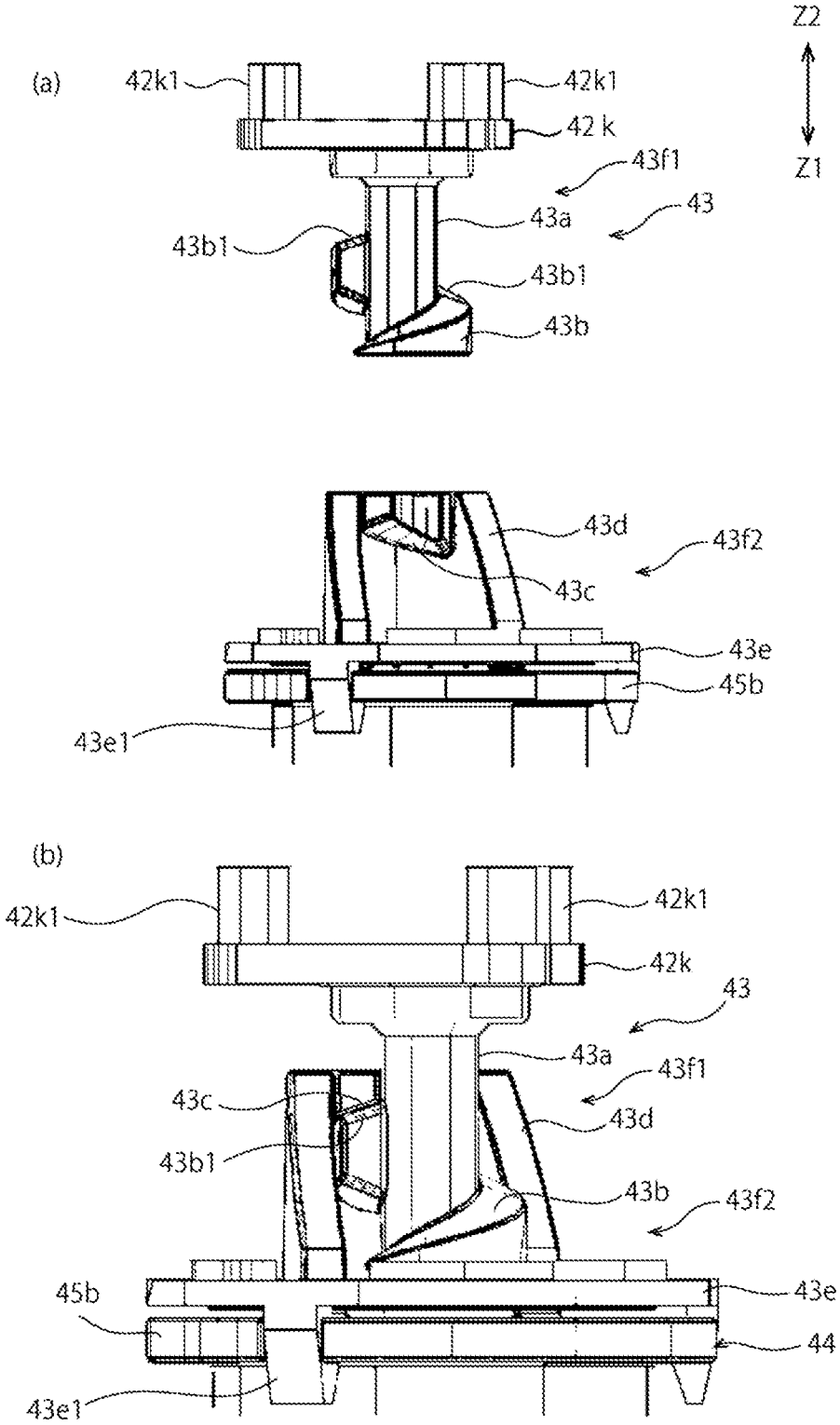
FIG. 4 is a stereo view illustrating a motion direction conversion mechanism included in the beating unit shown in FIG. 2.

Next, the structure of the motion direction conversion mechanism 43 will be described in detail with reference to FIG. 4. FIG. 4 is a perspective view illustrating the structure of the motion direction conversion mechanism 43. The motion direction conversion mechanism 43 is a mechanism that converts a rotational movement into a linear movement, and includes a lifting portion 43*f*1 and a linear direction moving portion 43*f*2. It should be noted that, FIG. 4(*a*) is a perspective view illustrating the lifting portion 43*f*1 and the linear direction moving portion 43*f*2, and FIG. 4(*b*) is a perspective view illustrating a state where the lifting portion 43*f*1 and the linear direction moving portion 43*f*2 are connected.

The lifting portion 43*f*1 has a reference axis 43*a* extending from the center of the fourth planetary carrier 42*k*, and a helical portion 43*b* having an inclined surface 43*b*1 spirally formed on a side surface of the reference axis 43*a*. The linear direction moving portion 43*f*2 includes a surrounding wall portion 43*d* that partially surrounds the periphery of the lifting portion 43*f*1, an abutting portion 43*c* provided on an end portion of the surrounding wall portion 43*d* in the return direction Z2 to come into contact with the inclined surface 43*b*1, a circular plate-shaped fixing plate 43*e*, which is provided at an end of the surrounding wall portion 43*d* in the protruding direction Z1 for the fixation of the piston 44. The fixing plate 43*e* fixes the fixed portion 45*b* of the piston 44 via the piston fixing claw 43*e*1. A spiral spring 43*g* (see FIG. 2) is disposed between the fixing plate 43*e* and the fourth planetary carrier 42*k*.

When the fourth carrier 42*k* rotates to make the lifting portion 43*f*1 rotate, the abutting portion 43*c* relatively moves on the inclined surface 43*b*1 and advances in the return direction Z2. Thus, the linear-direction moving portion 43*f*2 and the piston 44 move in the return direction Z2, and the head portion 34 rises. At this time, the spring 43*g* is pressed by the fixing plate 43*e* close to the fourth planetary carrier 42*k* to store the spring force. When the abutting portion 43*c* passes the end 43*b*1 of the inclined surface 43*b*1, the fixing plate 43*e* is pressed back in the protruding direction Z1 by the elastic force of the spring 43*g* shown in FIG. 2, and thus, the piston 44 and the head portion 34 integrally protrude in the protruding direction Z1. By repeating these actions, the head portion 34 vibrates.

As described above, the driving unit 1 is configured to attach and detach a beating unit 3 as a beating-type accessory. The beating unit 3 includes a motion direction conversion mechanism 43 that converts a rotational movement input via the input shaft 41 as a rotation input portion into a linear movement, a head portion 34, which is formed with a beating surface 34*c* and vibrates in an axis direction that is substantially orthogonal to the beating surface 34*c* by a linear motion converted by the motion direction conversion mechanism 43, a liquid accommodating portion 35 that can accommodate a liquid, and a water supply path 36 that is formed from the liquid accommodating portion 35 to the head portion 34, wherein the motion direction conversion mechanism 43 includes a reference axis 43*a* extending in the axial direction, an inclined surface 43*b*1 that is inclined relative to the axis direction and extends around the reference axis 43*a*, and a linear direction moving portion 43*f*2 that is connected to the head portion 34, relatively moves on the inclined surface 43*b*1 and moves in the axial direction by rotation of the reference axis 43*a*.

When such a configuration is adopted, the linear direction moving portion 43*f*2 is lifted along the inclined surface 43*b*1 and relatively moves in the return direction Z2 by the rotation of the reference axis 43*a*, and the rotary motion is converted into linear motion. Since the axial core of such a motion direction conversion mechanism 43 substantially coincides with that of the auxiliary side body housing, the beating unit 3 can reduce the diameter of the auxiliary side body housing 3 more significantly compared with the case of using the motion direction conversion mechanisms that have other structures and whose axes are biased relative to the auxiliary side body housing 37 to achieve the compactness. In addition, due to the linear movement converted by the planetary gear mechanism 42, the head portion 34 vibrates as the liquid in the liquid accommodating portion 35 is supplied from the water supply path 36 to the beating surface 34*c* of the head portion 34. Therefore, the head portion 34 can automatically beat the Clothes C as a stain removal target, so that the stain removal operation can be performed without moving the hand quickly.

Figure 5:
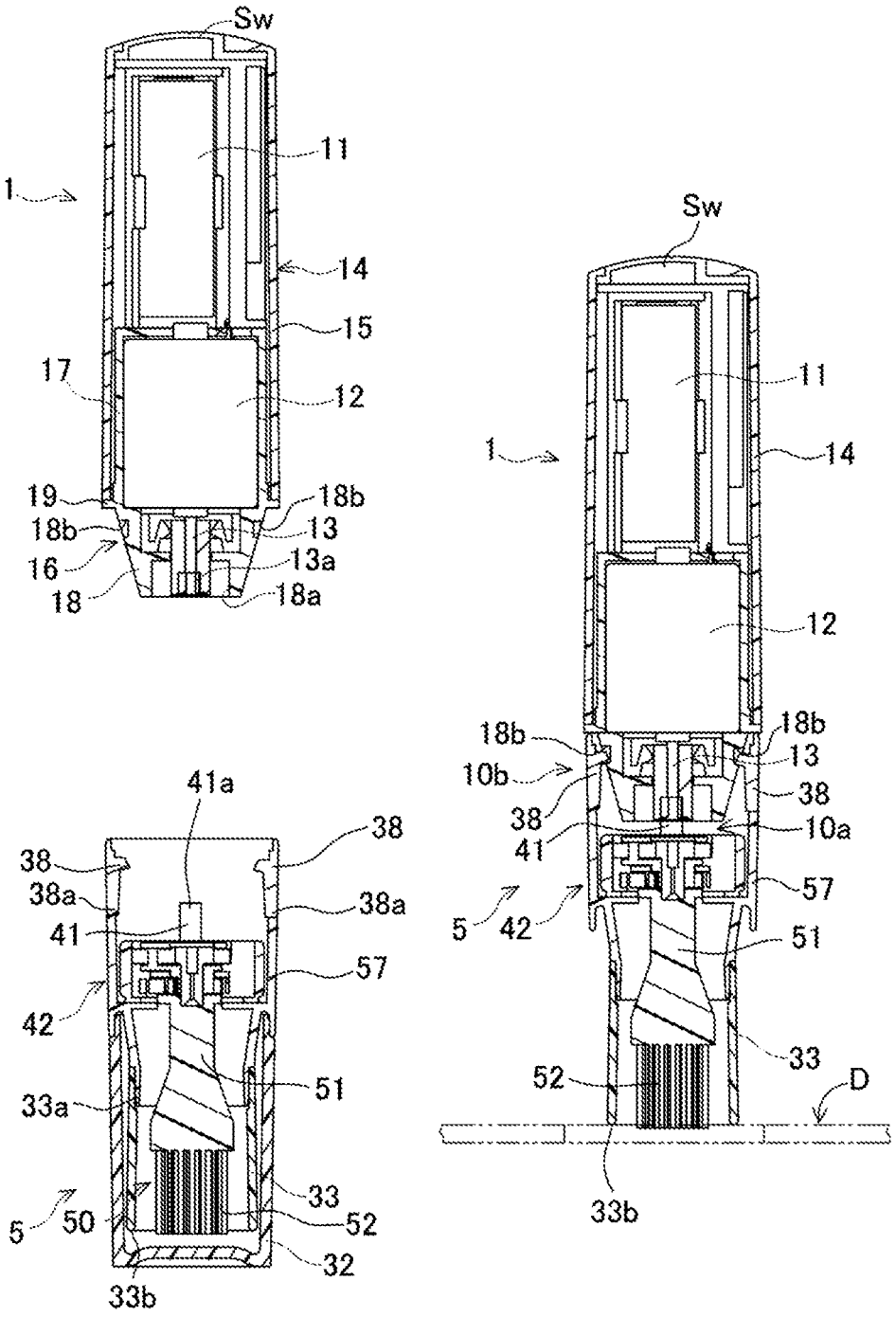
FIG. 5 is a longitudinal sectional view illustrating the same driving unit in a state where a brush unit as a brush-type accessory is combined.

FIG. 5 is a longitudinal sectional view illustrating a brush unit 5 as a brush-type accessory.

The brush unit 5 differs from the beating unit 3 in two points of replacing a head portion 35 and a liquid accommodating portion 35 with a rotary brush 50 and having no vibration portion 4. The same components as those described above are represented by the same reference numerals and will not be described below.

The rotary brush 50 includes a brush base 51 connected to the input shaft 41 via a planetary gear mechanism 42, and a brush portion 52 extending from the brush base 51. The top end of the brush portion 52 is set at a position slightly protruding from the top end 33*b* of the protective cover 33. By means of a rotational force transmitted through the input shaft 41 and decelerated by the planetary gear mechanism 42, the rotary brush 50 rotates with the axial core of the rotary brush 50 as the center. The brush unit 5 equipped with such a rotary brush 50 can clean comparatively hard articles such as sports shoes and wallpaper D, and thus, the range of the objects to be washed is enlarged.

Figure 6:
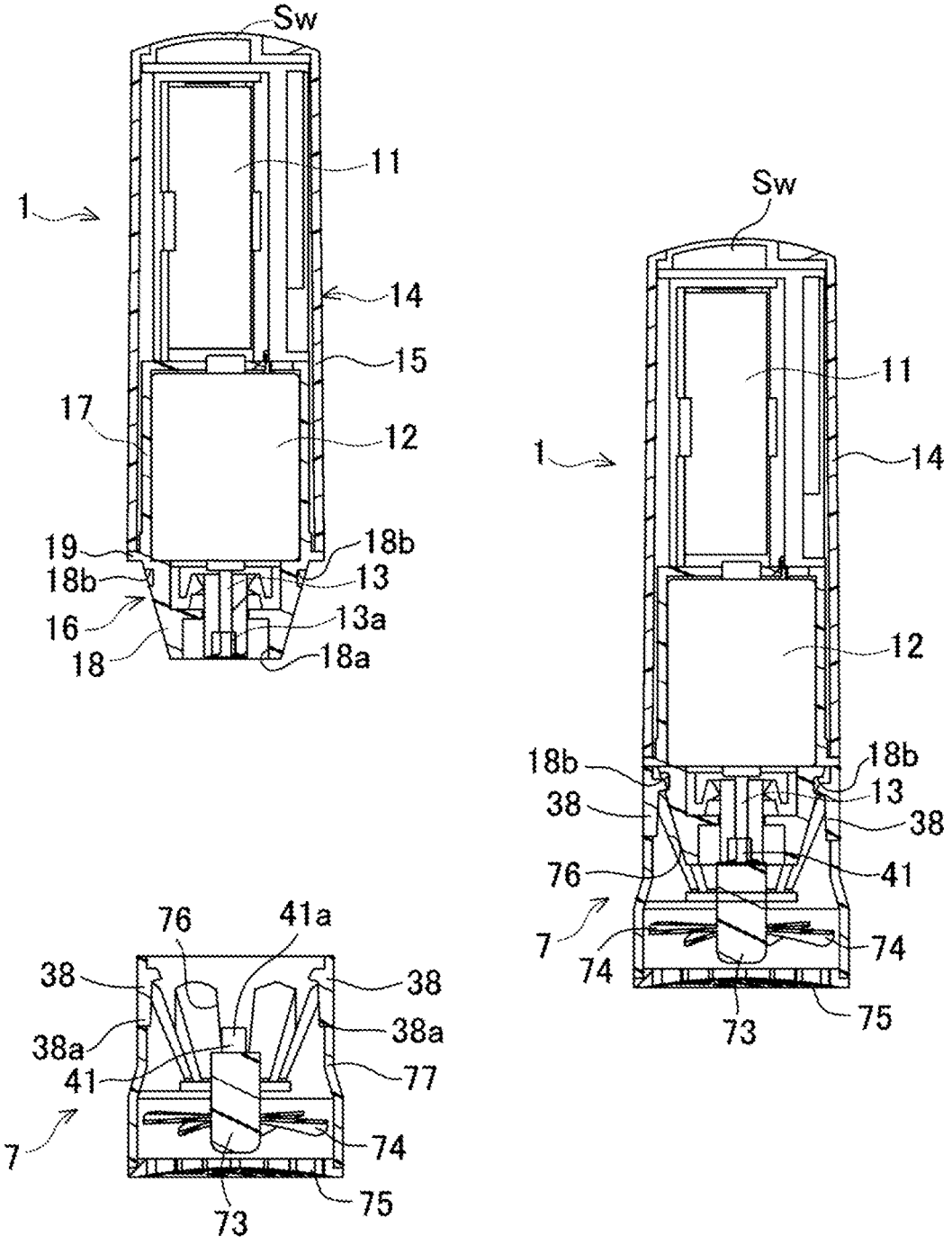
FIG. 6 is a longitudinal sectional view illustrating the same driving unit in a state where an impeller unit as an impeller-type accessory is combined.

FIG. 6 is a longitudinal sectional view illustrating an impeller unit 7 as an impeller-type accessory.

The impeller unit 7 has an input shaft 41 connected to the output shaft 13 of the driving unit 1, an impeller 74 having a rotation shaft 73 coupled to the input shaft 41, an auxiliary side body housing 77 that is provided therein with an input shaft 41 and an impeller 74, and a safety cover member 75 embedded in the opening at a side of the impeller 74 of the auxiliary side body housing 77. A plurality of air suction ports 76 that can supply air toward the rear surface of the impeller 74 is formed on the side surface of the auxiliary side body housing 77. Since such an impeller unit 7 causes rotation of the impeller 74 to generate wind by the rotational force transmitted through the input shaft 41, the wind energy can dry the portion that is wetted particularly due to the washing of the beating unit, thereby increasing additional functions such as the drying function.

The portable washing units X1, X2 and X3 that automatically perform various washing treatments are configured by a combination of the driving unit 1 and at least one of the units 3, 5, and 7 as described above.

The first embodiment of the present disclosure has been described above, but the specific structure of each part is not limited to the above-described embodiment.

Figure 7:
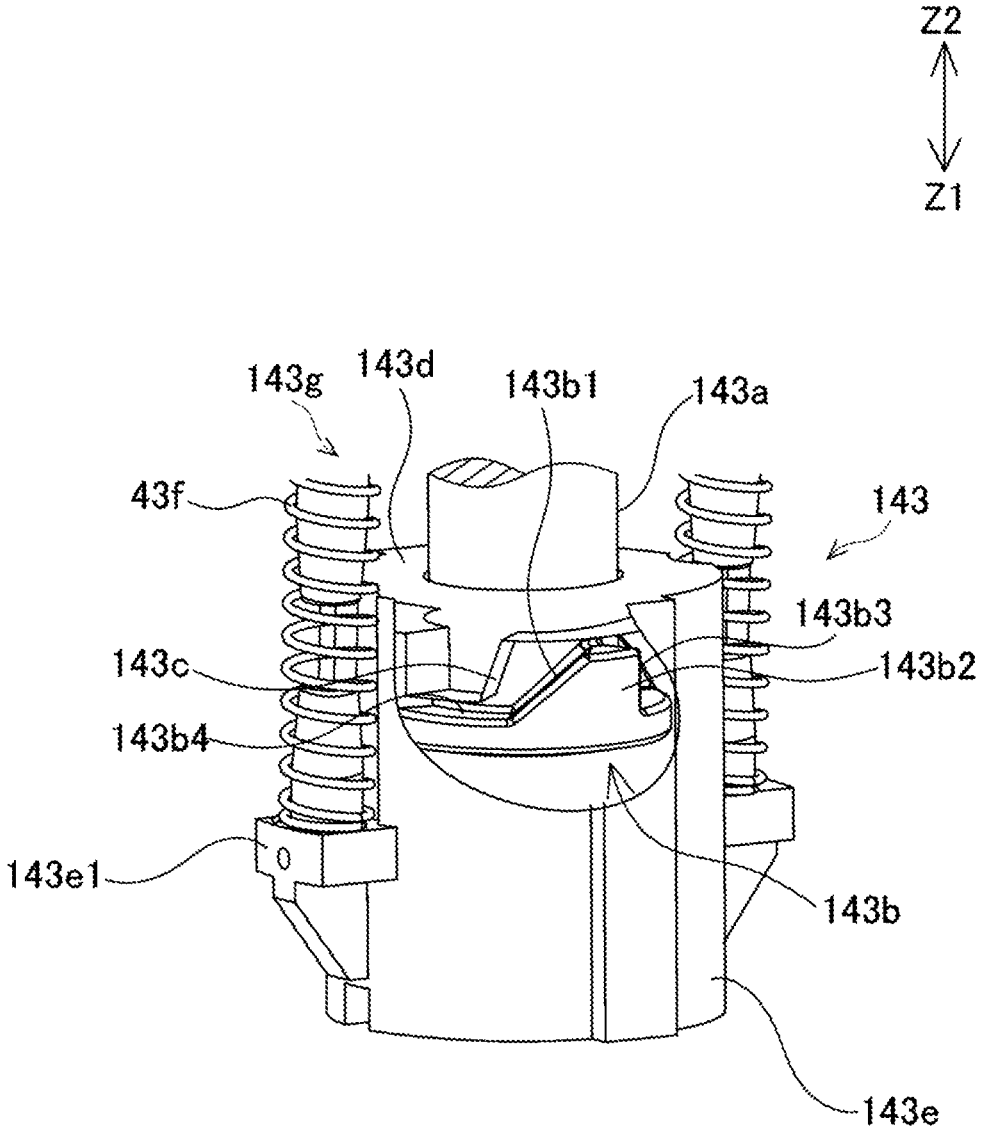
FIG. 7 is a view illustrating a modification of the first embodiment.

For example, the structure of the motion direction conversion mechanism 43 is not limited to the above-described structure having the inclined surface 43*b*1 extending in a spiral shape, and may be the structure shown in FIG. 7.

FIG. 7 is a view illustrating a modification of the motion direction conversion mechanism 43 shown in FIG. 4. The motion direction conversion mechanism 143 provided in the present modified example includes a lifting portion 143*b* in which an inclined region 143*b*2 is formed, and a linear direction moving portion 143*g* that is lifted by the lift portion 143*b* toward the return direction Z2.

The lifting portion 143*b* includes a reference axis 143*a* connected to the planetary gear mechanism 42 (see FIG. 3 and the like) and an inclined region 143*b*2 that has a substantially trapezoidal shape viewed from the front, is positioned at an end portion at the side of the protruding direction Z1 of the reference axis 143*a* and is formed at the radial outside of the reference axis 143*a*. The inclined regions 143*b*2 protrude in the return direction Z2 and, are formed at equal intervals in the circumferential direction. In such an inclined region 143*b*2, an inclined surface 143*b*1 is formed on the rotation direction side of the reference axis 143*a*, and a vertical surface 143*b*3 is formed on the opposite side. In addition, a flat surface 143*b*4 is formed between the inclined surface 143*b*1 and the vertical surface 143*b*3 on the lifting portion 143*b*.

The linear direction moving portion 143*g* includes a substantially cylindrical piston fixing portion 143*e* fixed to the piston 44 (see FIG. 2 and the like), an end surface portion 143*d* formed at an end at the side of the return direction Y2 of the piston fixing portion 143*e*, and an abutting portion 143*c*, which is opposite to the inclined surface 143*b*1 and the flat surface 143*b*4 and has a substantially trapezoidal shape viewed from the front.

The end surface portion 143*d* blocks the opening at a side of the return direction Y2 of the piston fixing portion 143*e*, and the reference axis 143*a* penetrates the center portion. The contact portion 143*c* protrudes in the protruding direction Z1 from a peripheral portion of the end surface portion 143*d*.

In such a movement direction changing mechanism 143, the lifting portion 143*b* is rotated by the rotation of the reference axis 143*a*. When the inclined surface 143*b*1 of the lifting portion 143*b* contacts the abutting portion 143*c*, the abutting portion 143*c* relatively moves along the inclined surface 143*b*1, and the linear direction moving portion 143*g* is lifted in the return direction Z2. At this time, the spring 43*f* is pressed between the fourth planetary carrier 42*k* (see FIG. 4) and the spring supporting portion 143*e*1 formed at the piston fixing portion 143*e* to accumulate the spring force. Accordingly, the piston 44 and the liquid accommodating portion 35 move in the return direction Z2, and the head portion 34 is lifted integrally with them. Then, the abutting portion 143*c* relatively moves on the flat protruding end surface of the inclined region 143*b*2, and when passing the vertical surface 143*b*3, the elastic force through the spring 43*f* is pushed toward the protruding direction Z1, and thus, the head portion 34 protrudes in the protruding direction Z1. The abutting portion 143*c* relatively moves along the flat surface 143*b*4 toward the next inclined region 143*b*2. By repeating such action, the head 34 vibrates.

Figure 8:
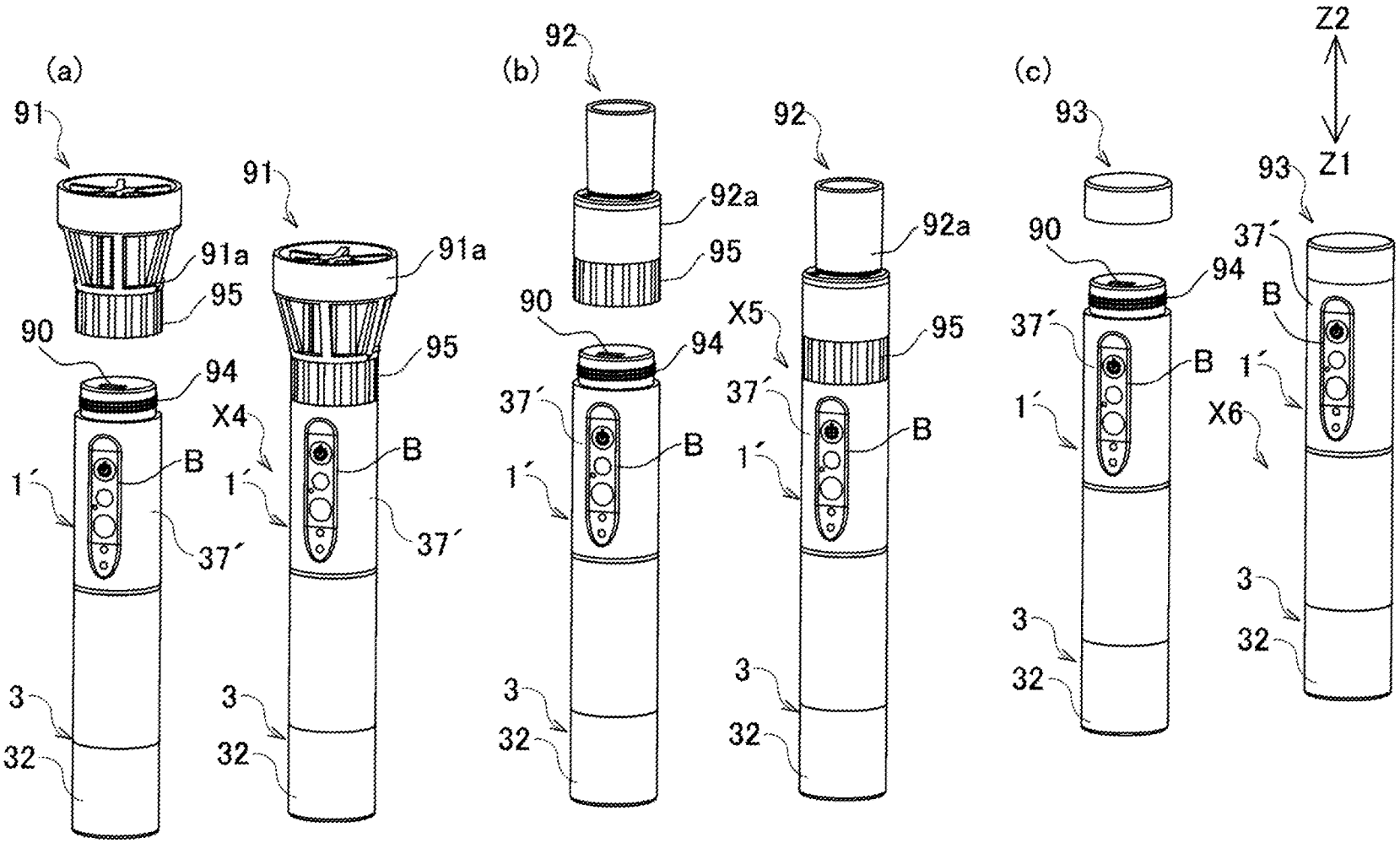
FIG. 8 is a view illustrating another modification of the first embodiment.

FIG. 8 is a front view illustrating another modification of the present disclosure. As shown in FIG. 8, the driving unit 1' may be configured such that a USB connection portion 90 is formed at an end at a side of the return direction Z2, and by means of the power supply from the battery 11 (see FIG. 2), the accessory that is attachable to and detachable from the USB connection portion 90 can be driven. It is noted that, the driving unit 1' has the same structure as that of the driving unit 1 of the first embodiment shown in FIG. 2 and the like except that it is formed with the USB connection portion 90 and the driving side attaching-detaching portion 94 and is formed with an operation portion B having a plurality of switches at the side surface thereof.

The driving unit 1' connects the impeller unit 91 shown in FIG. 8(*a*) and the brush unit 92 shown in FIG. 8(*b*) that serve as the above accessories via the USB connection portion 90 so as to perform brushing and air-drying in a state where a beating unit 3 is mounted at an end portion on the side in the protruding direction Z1. The structures of the impeller unit 91 and the brush unit 92 will be described later with reference to FIGS. 10 and 15.

The driving side body housing 37' of the driving unit 1' and the auxiliary side body housings 91*a* and 92*a* of the units 91 and 92 can be integrally connected via the driving side attaching-detaching portion 94 and the auxiliary side attaching-detaching portion 95. In addition, when the units 91 and 92 are not mounted, the driving unit 1' may assemble the cover member 93 shown in FIG. 8(*c*) via the driving side attaching-detaching portion 94 so that the USB connection portion 90 can be covered.

The portable washing units X4, X5 and X6 are configured by the driving unit 1', the beating unit 3, the units 91 and 92 and the cover member 93. The portable washing units X4 and X5 are configured to drive the beating unit 3 or the units 91 and 92 by operating a certain switch owned by the operation unit B of the driving unit 1'. In addition, it should be noted that, the brush unit 5, the impeller unit 7, etc. can be mounted at the driving unit 1' to replace the beat unit 3.

Due to the battery 11 that supplies power to the motor 12 and the USB connection portion 90 capable of receiving the power from the battery 11 and connecting the unillustrated USB terminal, the utilization range can be enlarged, and a plurality of washing treatments can be carried out without replacing the unit 3 that is mounted in the engagement recessed portion 18*b* as the driving side attaching-detaching portion with other types of accessories.

In addition, in addition to attaching and detaching the components of the detachable beating unit 3, the brush unit 5 and the impeller unit 7, the driving unit 1 also can be configured to attach and detach the other components as the accessories. Further, it may have a structure connecting a heater (an iron)-type accessory that is provided therein with a heater by means of a USB connection portion 90.

Second Embodiment

Figure 9:
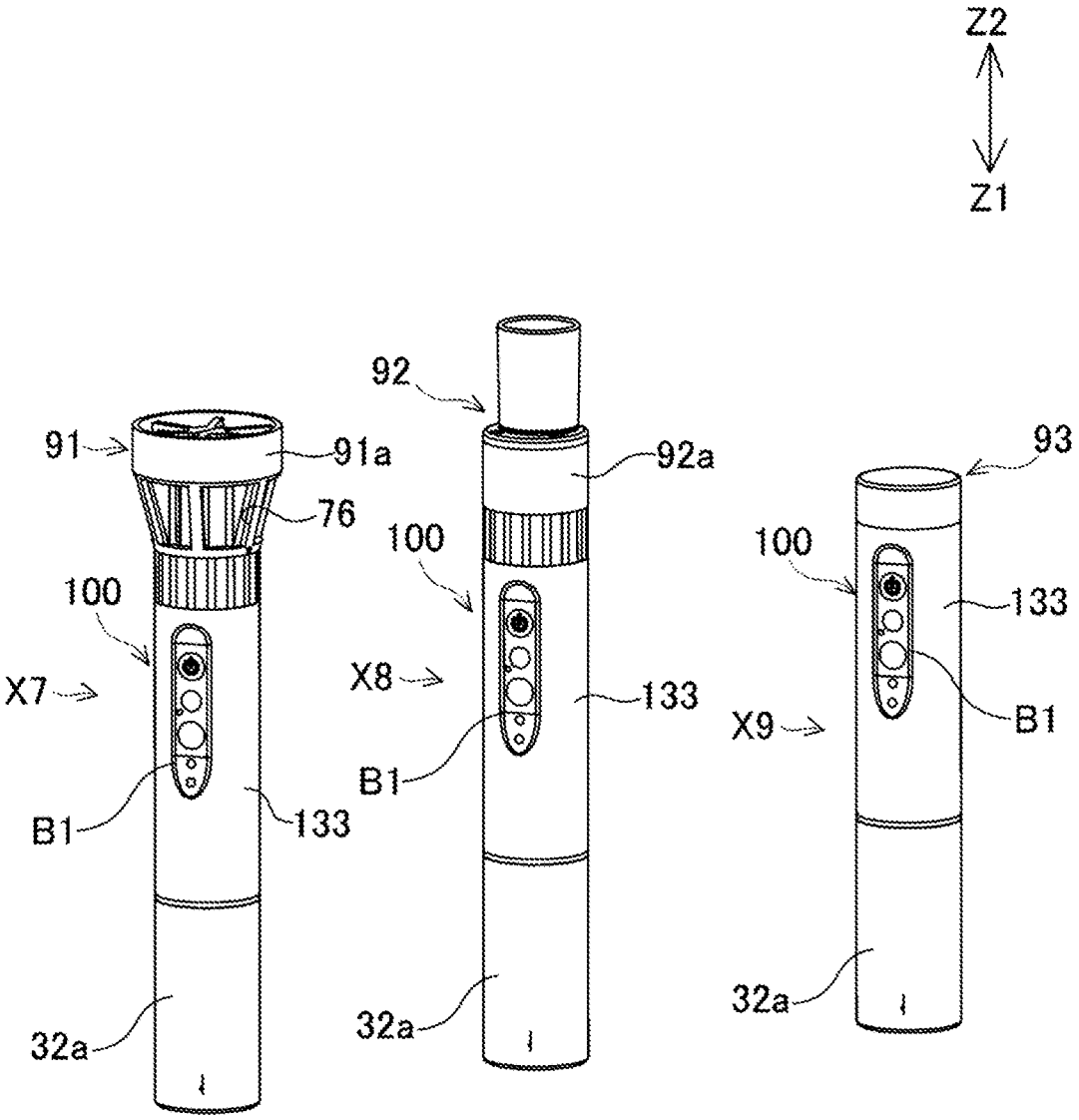
FIG. 9 is a front view illustrating a beating and washing unit in the second embodiment of the present disclosure in a state where various types of accessories and protective covers are mounted respectively.
Figure 10:
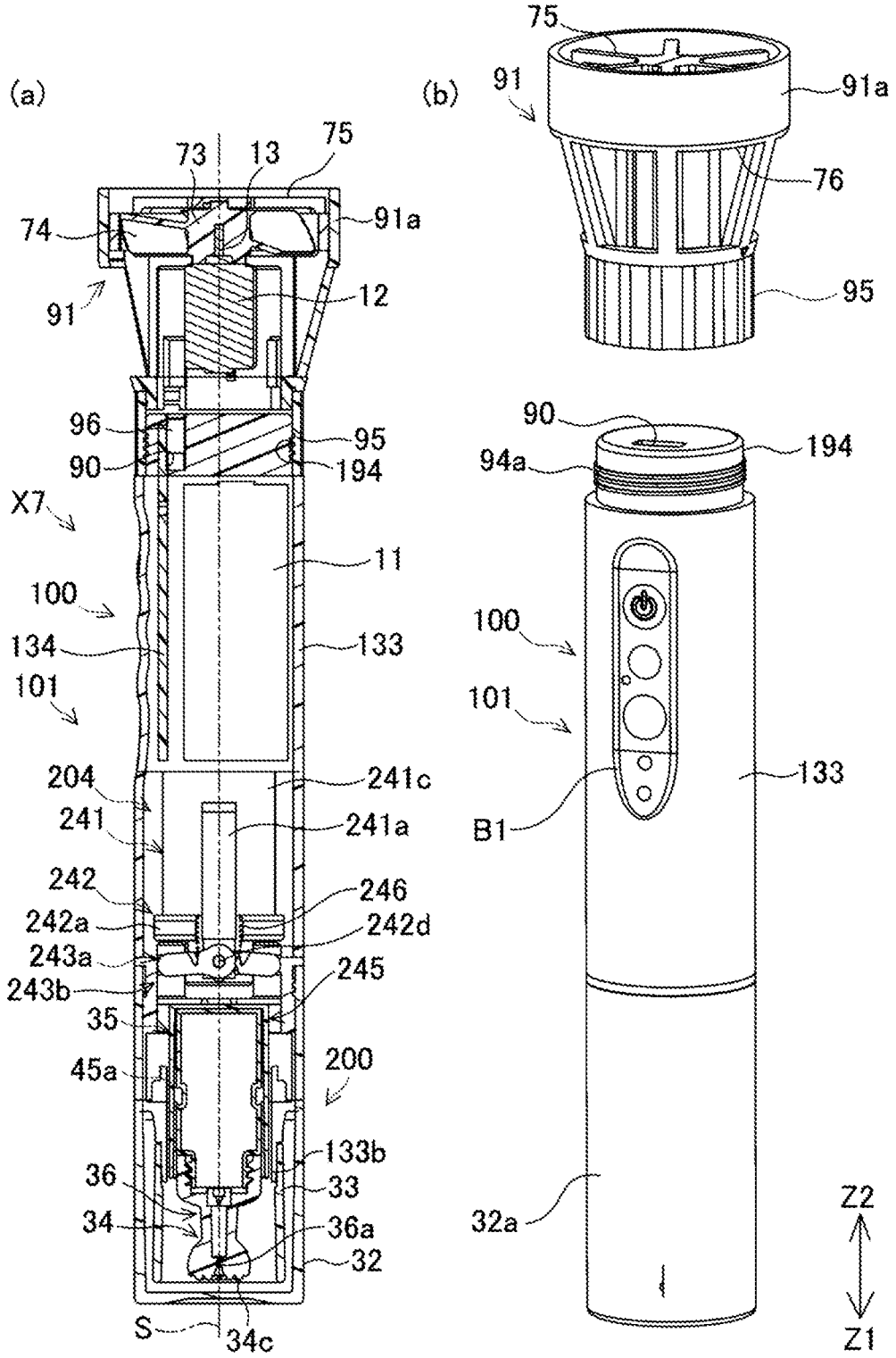
FIG. 10 is a view illustrating the same beating and washing unit in a state in which an impeller unit as an impeller-type accessory is combined.

FIG. 9 is a front view illustrating a portable beating and washing unit (hereinafter, simply referred to as a "beating and washing unit") in the second embodiment of the present disclosure in a state where various accessories 91 and 92 of different types are mounted respectively. FIG. 10(*a*) is a longitudinal sectional view illustrating the beating and washing unit 100 in a state where the impeller unit 91 as the impeller-type accessory is combined. FIG. 10(*b*) is a perspective view illustrating the beating and washing unit 100 in a state where the impeller unit 91 is removed. The same reference numerals are given to the same components as those in the first embodiment, and the descriptions thereof are omitted.

As shown in FIG. 10, the beating and washing unit 100 as the washing unit body includes a device body 101, a cover member 32 and a protective cover 33 (a guider).

The device body 101 includes a head portion 34, a liquid accommodating portion 35, a water supply path 36, a vibration portion 204, a battery 11, and a beating side body housing in a substantially bottomed cylindrical shape that is provided with the above components therein. The head portion 34, the liquid accommodating portion 35, the water supply path 36, and the vibration portion 204 constitute a washing mechanism 200.

In the present embodiment, the head portion 34 is vibrated by the driving of the electromagnetic actuator 241 located on the extension line of the axis S of the head portion 34 orthogonal to the beating surface 34*c*, which is different from the structure of a combination of the beating unit 4 on the driving unit 1 in the first embodiment. In addition, the mechanism that vibrates the head portion 34 is not separated from the battery, and they are provided inside the same beating side body housing 133, which is different from the case in the first embodiment.

The electromagnetic actuator 241 includes a movable iron core 241*a* that is alternately turned on or turned off by means of energization of the unillustrated coil so as to move toward the vibration direction. The axis of the movable core 241*a* is set on an extension line of the axis S of the head portion 34.

Figure 11:
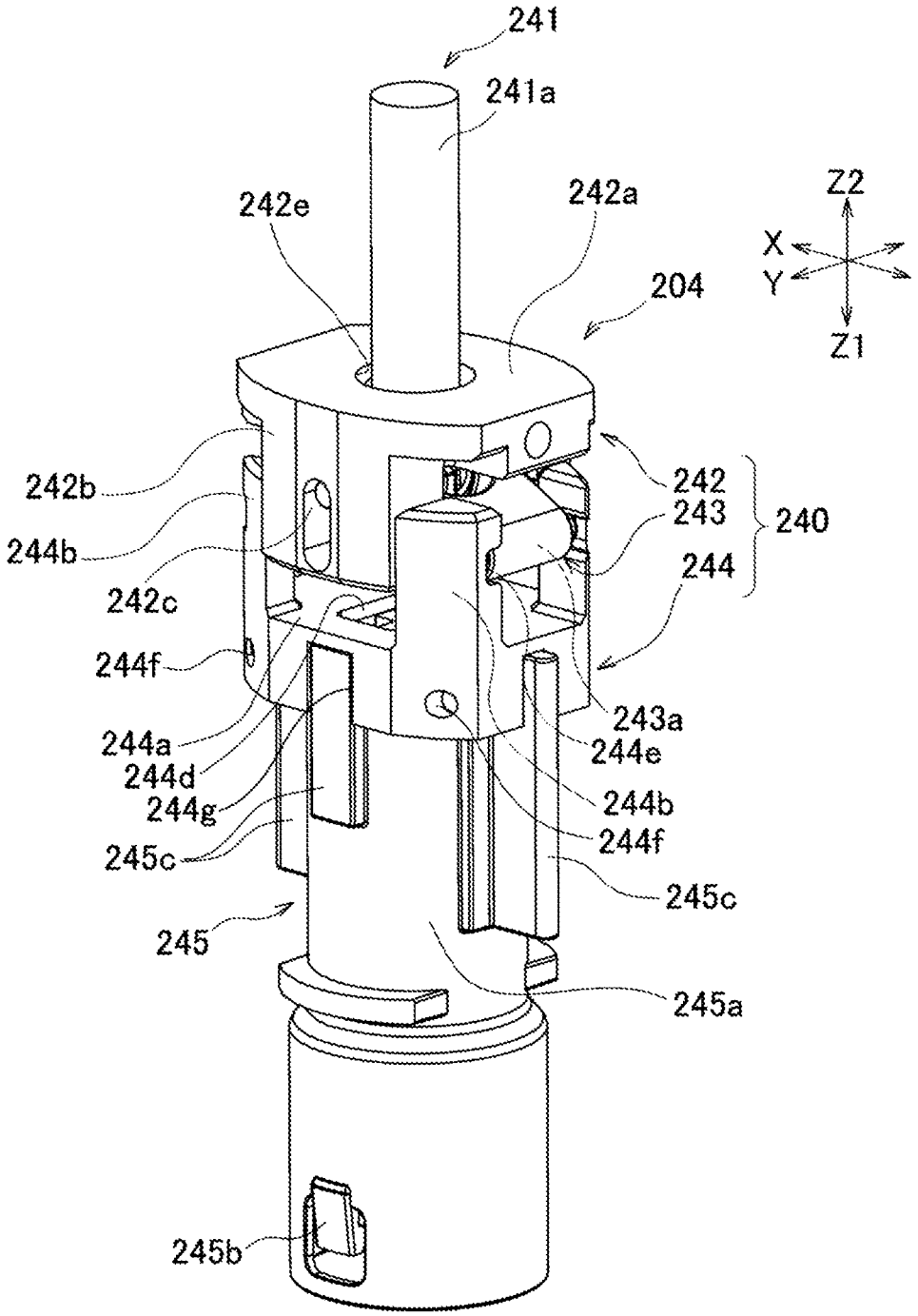
FIG. 11 is a stereo view illustrating a vibration portion constituting the same beating and washing unit.
Figure 12:
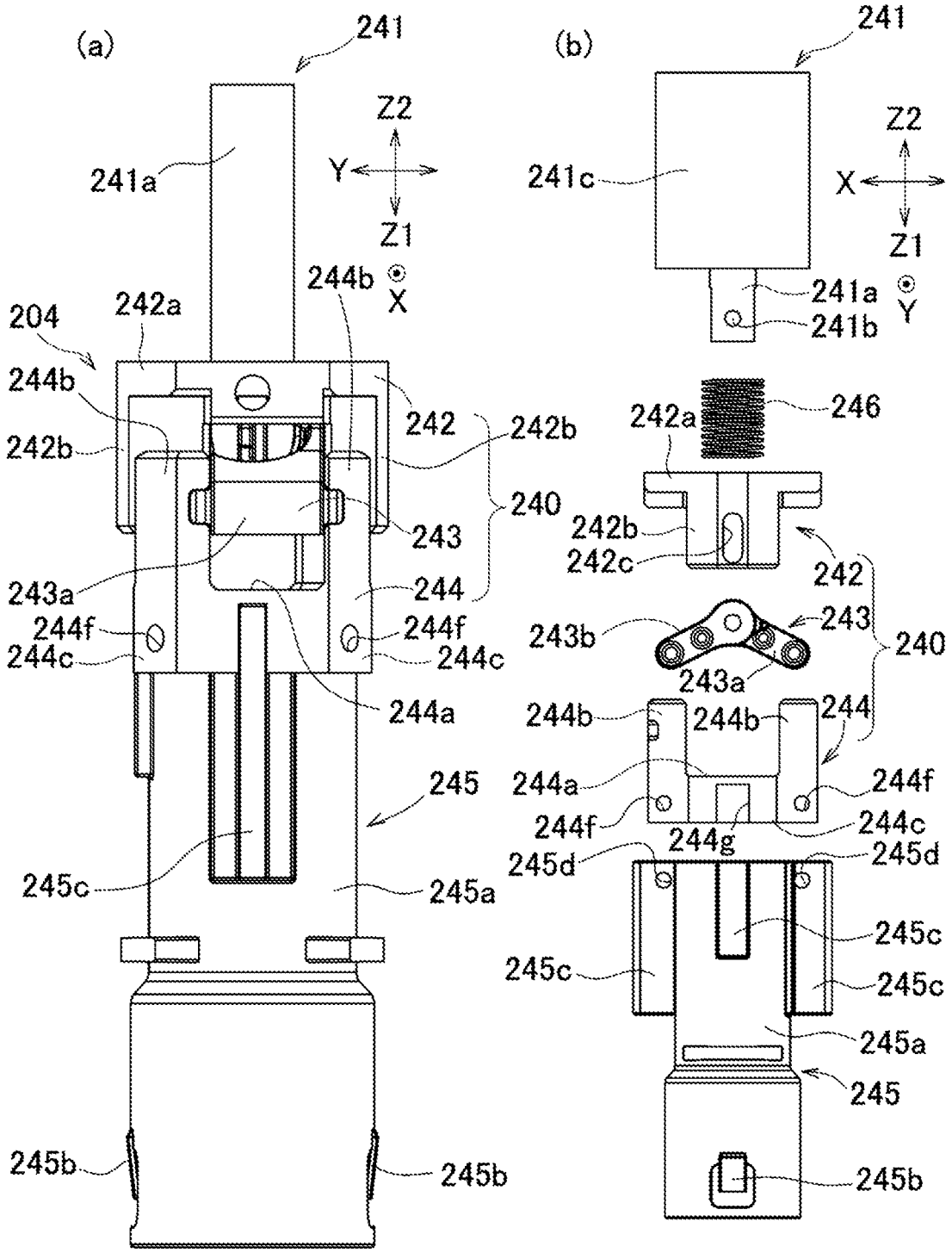
FIG. 12 is a view illustrating a vibration portion constituting the same beating and washing unit.
Figure 13:
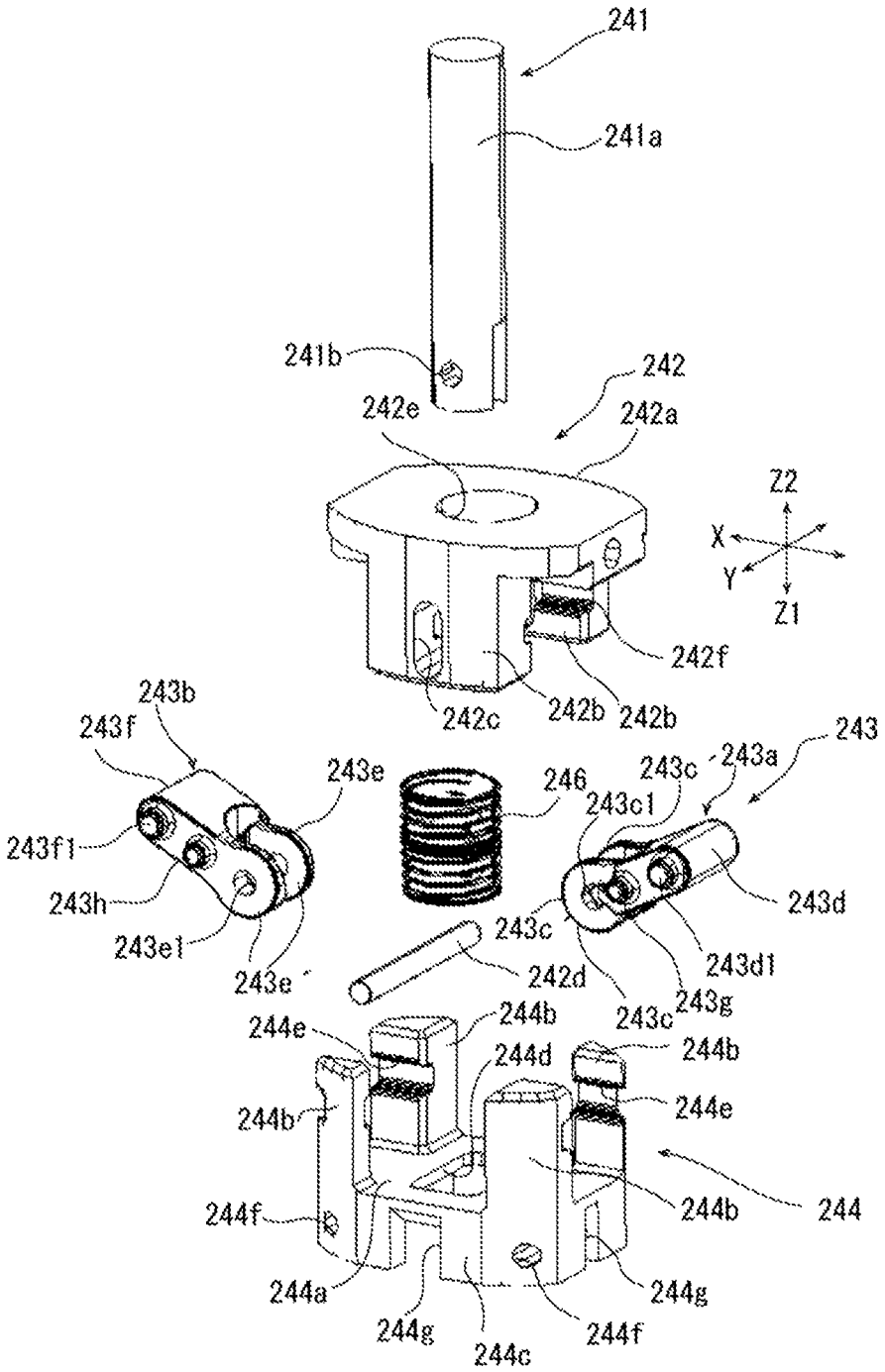
FIG. 13 is an explosive stereo view illustrating components of the same vibration portion.
Figure 14:
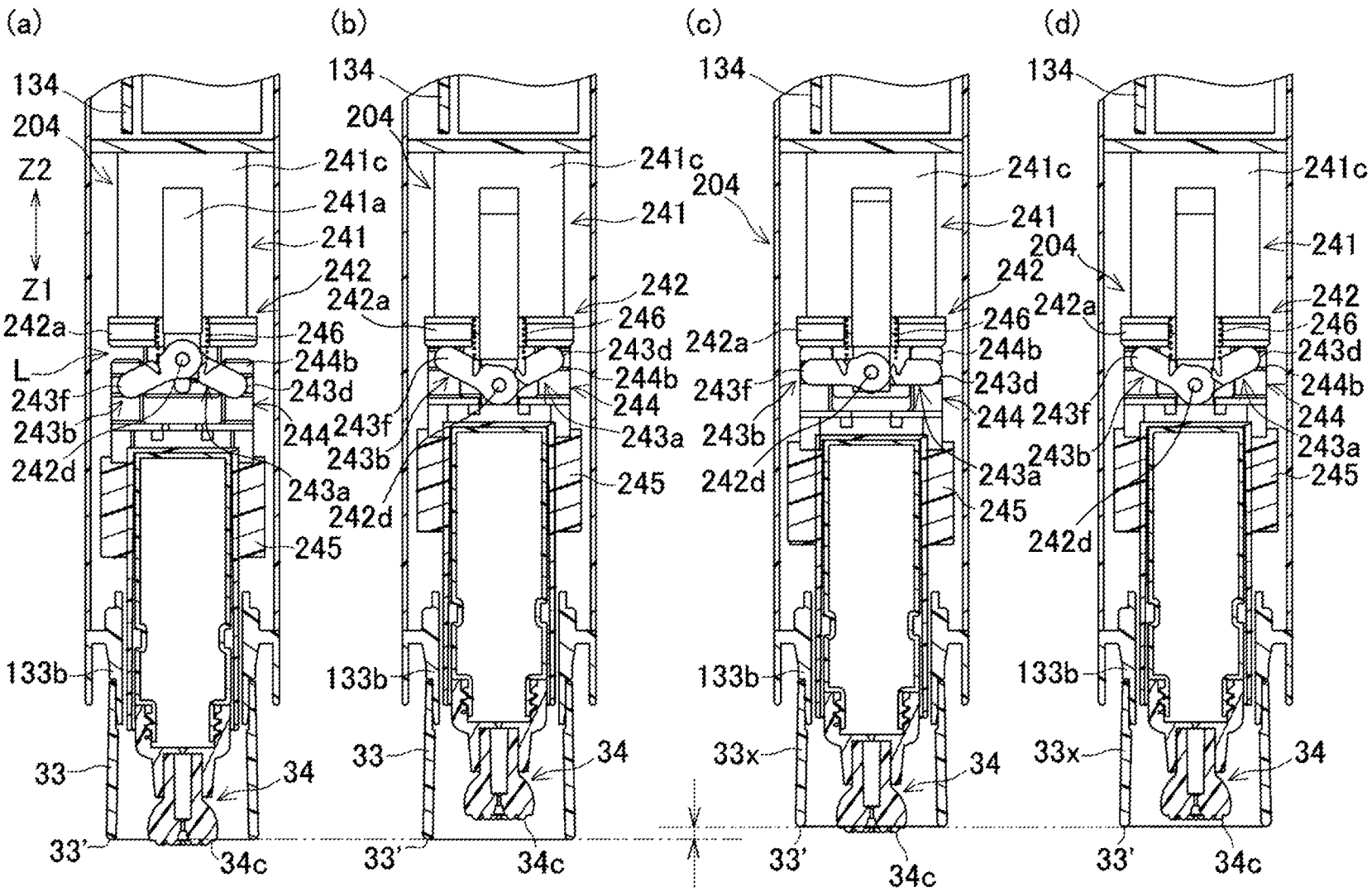
FIG. 14 is a longitudinal sectional view illustrating the vibration state of the same beating and washing unit.

FIG. 11 is a perspective view illustrating the vibration portion 204. FIG. 12(*a*) is a top view showing the vibration portion 204, FIG. 12(*b*) is an exploded perspective view illustrating components of the vibration portion 204, FIG. 13 is a perspective view illustrating components of the vibration portion 204, and FIG. 14 is a view for explaining the actions performed to vibrate the head portion 34. Hereinafter, the structure of the vibration portion 204 will be specifically described with reference to FIGS. 11 to 14.

As shown in FIG. 12(*b*), the vibration portion 204 includes the above-described electromagnetic actuator 241, a coil spring 246, a link mechanism 240 and a piston 245.

As shown in FIGS. 11 to 13, the link mechanism 240 includes an electromagnetic coupling portion 242, a link portion 243 and a piston fixing portion 244.

As shown in FIG. 13, the electromagnetic coupling portion 242 includes a fixed side base portion 242*a*, which is a plate-shaped member that is substantially parallel to the beating surface 34*c* shown in FIG. 10, a protruding direction extending portion 242*b*, which extends from both end portions in the first direction Y to the protruding direction Z1, respectively, and an engaging pin 242*d*, which penetrates the long hole 242*c* to be described later. A circular iron core through-hole 242*e* for the penetration of the movable iron core 241*a* in which the coil spring 246 is inserted is formed at the center of the fixed side base portion 242*a*. In addition, a long hole 242*c* extending in the vibration direction through which the engaging pin 242*d* penetrates is formed at the central portion in the second direction X of each protruding direction extending portion 242*b*, and at the inner surface of the protruding direction extending portion 242*b*, a first connecting groove 242*f* is formed along the second direction X. The second engagement protrusions 243*g* and 243*h* owned by the first link member 243*a* and the second link member 243*b*, which will be described later, are movably engaged with the first connection groove 242*f*.

As shown in FIG. 13, the link portion 243 has a first link member 243*a* and a second link member 243*b*. The first link member 243*a* and the second link member 243*b* have almost the same shape and have a thickness exceeding the diameter of the movable iron core 241*a* in the first direction Y.

The first link member 243*a* is formed with a pair of clips 243*c*' and 243*c*' that are separated from each other in the first direction Y at an end portion 243*c* close to the second link member 243*b*. The pair of clips 243*c*' and 243*c*' are formed with a pin penetration through-hole 243*c*1 for the passing through of the engaging pin 242*d*. In addition, first engagement protrusions 243*d*1 that protrude in reverse in the first direction Y are formed at the other end portion 243*d* of the first link member 243*a*. Further, second engagement protrusions 243*g* that are in parallel with the first engagement protrusions 243*d*1 and protrude in reverse are formed at the central portion in the longitudinal direction of the first link member 243*a*.

Similarly, as for the second link member 243*b*, a pair of clips 243*e*' and 243*e*' each having a pin through-hole 243*e*1 formed therein is formed at one end portion 243*e* close to the first link member 243*a*, and first engagement protrusion 243*f*1 that protrude in reverse in the first direction Y are formed at the other end portion 243*f* of the second link member 243*b*. In addition, second engagement protrusions 243*h* that protrude in reverse are formed at the central portion in the longitudinal direction of the second link member 243*b*.

A pin penetration through-hole 241*b* is formed at an end of the movable iron core 241*a* in the protruding direction Z1. The movable iron core 241*a* is inserted into the electromagnetic coupling portion 242 via the iron core through-hole 242*e*. The vicinity of the pin penetration through-hole 241*b* is clamped by the clips 243*c*' and 243*c*' of the first link member 243*a* and the clips 243*e*' and 243*e*' of the second link member 243*b* from the second direction X. At this time, one of the clips 243*c*' and 243*c*' of the first link member 243*a* is inserted between the pair of clips 243*e*' and 243*e*' of the second link member 243*b*, and the other of the clips 243*c*'and 243*c*' of the first link member 243*a* is inserted to the outside of the pair of clips 243*e*' and 243*e*' of the second link member 243*b*.

The engaging pin 242*d* passes through the clips 243*c*' and 243*c*' of the first link members 243*a* that overlap with each other, the pin penetration through-holes 243*c*1 and 43*e*1 of the clips 243*e*' and 243*e*' of the second link member 243*b* and the pin penetration through-hole 241*b* of the movable iron core 241*a*. In addition, both ends of the engaging pin 242*d* are inserted into the long hole 242*c* formed in the electromagnetic coupling portion 242 and engaged with the long hole 242*c*.

In a state of the coil spring 246 being wound around the movable iron core 241*a*, one end abuts with the engaging pin 242*d*, and the other end abuts with (or close to) to the solenoid main body 241*c* shown in FIG. 12 (*b*), and they are accommodated among clips 243*c*', 243*c*' (243*e*', 243*e*'). As a result, the movable iron core 241*a* and the link members 243*a*, 243*b* are connected to each other via the engaging pin 242*d*.

The piston fixing portion 244 includes a movable side base portion 244*a*, which is a plate-shaped member that is substantially parallel to the beating surface 34*c* illustrated in FIG. 10, and a return direction projecting portion 244*b*, which extends from the four corners of the movable side base portion 244*a* in the return direction Z2, and a piston covering portion 244*c* extending in the projecting direction Z1 from the four corners of the movable side base portion 244*a*. As shown in FIG. 13, the central portion of the movable side base portion 244*a* is formed with an opening 244*d* into which a part of the clips 243*c*' and 243*e*' of the link portion 243 enters when protruding toward the protruding direction Z1 of the movable iron core 241*a*. On the inner surface of the return direction projecting portion 244*b*, a second connection groove 244*e* is formed in the second direction X. In the second connection groove 244*e*, the first engagement protrusions 243*d*1 and 243*f*1 formed in the first link member 243*a* and the second link member 243*b* are engaged in the groove in a manner of free movement.

In the piston covering portion 244*c*, notches 244*g* that are notched toward the return direction Z2 are formed at a plurality of positions. As shown in FIG. 11, via the cutout 244*g*, the piston covering portion 244*c* is engaged with a piston fixed portion 245*c* that extends from the body holding portion 45*a* of the piston 245 to be described later to the outside in the circumferential direction. In addition, fixing holes 244*f* and 245*d* (see FIG. 12(*b*)) are formed on the piston covering portion 244*c* and the piston fixed portion 245*c* in the first direction Y. The piston fixing portion 244 and the piston 245 are fixed to each other by inserting a screw or the like (not shown) into the fixing holes 244*f* and 245*d* in a state where the piston covering portion 244*c* is engaged with the end of the body holding portion 45*a* at the side in the return direction Z2.

The piston 245 shown in FIGS. 11 and 12 is a member that supports the liquid accommodating portion 35 in a manner of placing the beating surface 34*c* at the top end (see FIG. 10) and can move in the vibration direction. The piston 245 includes a bottle holding portion 45*a* and a piston fixed portion 245*c*.

Here, as shown in FIG. 14, the electromagnetic actuator 241 is a non-through type electromagnetic actuator in which one end at the side of the return direction Z2 is blocked, and is a single-acting electromagnetic actuator as follows: when it abuts with the solenoid main body 241*c*, the movement of the movable iron core 241*a* is stopped, and when the coil (not shown) is energized, the movable iron core 241*a* is pulled upward in the return direction Z2. When the movable iron core 241*a* receives an attractive force in the return direction Z2, the engaging pin 242*d* moves in the return direction Z2 along the long hole 242*c*, and one end portion 243*c* of the first link member 243*a* into which the engaging pin 242*d* is inserted and one end 243*e* of the second link member 243*b* move in the return direction Z2. As a result, the other end 243*d* of the first link member 243*a* and the other end 243*f* of the second link member 243*b* illustrated in FIG. 13 transmit the force facing the protruding direction Z1 to the second connection groove 244*e* via the first engagement protrusions 243*d*1 and 243*f*1. As shown in FIG. 14(*a*), the piston fixing portion 244 and the piston 245 integrally protrude to the direction Z1, and the head portion 34 protrudes to a position that slightly protrudes beyond the protruding end 33' of the protective cover 33. At this time, between the fixed side base portion 242*a* of the electromagnetic connection portion 242 and the extension portion 244*b* in the return direction of the piston fixing portion 244, a gap L is formed in the vibration direction. The spiral spring 246 is pressed between the engaging pin 242*d* and the solenoid main body 241*c* to store the elastic force.

When the energization of the electromagnetic actuator 241 is disconnected, a force toward the protruding direction Z1 is applied to the engaging pin 242*d* by the elastic force of the coil spring 246. Accordingly, the first link member 243*a*, the second link member 243*b*, and the movable iron core 241*a* illustrated in FIG. 13, which relates to the insertion of the engaging pin 242*d*, move in the protruding direction Z1, pass through the other end portion 243*d* of the first link member 243*a* and the other end portion 243*f* of the second link member 243*b*, and transmit a force toward the return direction Z2 to the second connection groove 244*e* via the first engagement protrusions 243*d*1 and 43*f*1. By means of the release (return) on the movable iron core 241*a* and the use of the coil spring 246, even if the beating and washing unit 100 in an inclined state is used, as shown in FIG. 14(*b*), the piston fixing portion 244 and the piston 245 also can move integrally and reliably toward the direction Z2, and the head portion 34 is lifted by a predetermined size (about 5 mm in the present embodiment). Then, the fixed side base portion 242*a* of the electromagnetic connection portion 242 and the extension portion of the return portion 244*b* of the piston fixing portion 244 abut with each other, and the movement toward the protruding direction Z1 of the movable iron core 241*a* is stopped.

By repeating such an action, the head portion 34 vibrates (amplitude motion).

Here, when the electromagnetic actuator 241 provides the movable iron core 241*a* with an attractive force in a direction away from the head portion 34, that is, in the return direction Z2, the electromagnetic actuator 241 can exert the strongest force when the movable iron core 241*a* is lifted upward in the return direction Z2. Therefore, with a link mechanism 240 that makes the head portion 34 protrude in the direction opposite to the displacement direction of the movable iron core 241*a*, the vibration portion enables the head portion 34 to protrude (be pulled out) when the movable iron core 241*a* is absorbed to the return direction Z2 so as to improve the beating force.

In the present embodiment, a plurality of protective covers 33, 33*x* having different lengths (heights) of vibration directions in the range of operation of the electromagnetic actuator 241 can be replaced at the top end portion 133*b* of the beating side body housing 133.

When the electromagnetic actuator 241 abuts with the clothes C or the like placed on the stage at the beating surface 34*c* of the head portion 34, for example, the pulling-up of the movable iron core 241*a* can be mechanically stopped midway even in the middle of the working stroke. In the case where the protective cover is replaced with a protective cover 33*x* having a length shorter than that of the length of the vibration direction of the protective cover 33 by about 2 mm (or in the case of the use of a member having a variable vibration direction and the length of the vibration direction of the protective cover 33 being reduced to about 2 mm), as shown in FIG. 14(*c*), the movable iron core 241*a* stops before it is pulled to a position where it abuts with the solenoid main body 241*c*, and the pulling dimension of the electromagnetic actuator 241 does not reach the maximum. Then, from this position, as shown in FIG. 14(*d*), the movable iron core 241*a* is pushed out in the protruding direction Z1 by the coil spring 246. As a result, the operating stroke of the electromagnetic actuator 241 is shortened, and the beating force applied to the clothes C by the head portion 34 is weaker (smaller) compared with the case of using the protective cover 33.

As described above, in the case of the use of the protective cover 33 to pull the dimension of the electromagnetic actuator 241 to a maximum dimension, the operating stroke is, for example, about 4 mm, and the beating force becomes strong. On the other hand, in the case where the protective cover 33 is used while the pulling dimension does not reach a maximum dimension, the operating stroke is, for example, 2 mm, and the beating force becomes weak.

With such a structure, it is not necessary to electrically switch the electromagnetic actuator 241. The protective cover 33, 33*x* attached to the beating side body housing 133 can be changed to change the distance from the top end portion 133*b* of the beating side body housing 133 to the clothes C, and can mechanically change the operating stroke of the electromagnetic actuator 241. At the time of electrically adjusting the operating stroke by means of a control board 34 just for adjusting the beating force, for example, although there is the possibility of the increase of the components and the enlargement of the dimension of the device, the use of the structures of several protective covers 33, 5*x* having different replaceable mounting lengths can realize the miniaturization of the device, and the strength of the beating force applied to the clothes C by the head portion 34 can be adjusted.

In the present embodiment, when the operation button (switch portion) B (refer to FIG. 9) is operated, the operating frequency of the electromagnetic actuator 241 can be changed, and the vibration speed (beating speed) of the head portion 34 can be changed by the control board 134 (see FIG. 10) disposed adjacent to the battery 11. Therefore, the strength and the speed of the beating force can be adjusted corresponding to the type of the clothes C. For example, it is possible to realize a plurality of washing modes such as soft washing featured by a weak beating speed and a slow washing speed, and a strong washing featured by a strong beating force and a high speed.

As shown in FIGS. 9 and 10, the above-described beating and washing unit 100, can detachably attach and detach washing-related accessories. As shown in FIG. 10(*b*), the driving side connection portion 94 engaged with the auxiliary side attaching-detaching portion 95 is formed in a manner of cylindrical protrusion at the end portion of the return direction side Z2 on the beating side body housing 133. Such a driving side connection portion 94 is formed with a plurality of annular protruding portions 94*a* separated from each other in the vibration direction at the side, and a USB connection portion 90 is formed on the end surface thereof. The beating and washing unit 100 can supply the power of the battery 11 to the accessory and drive it via the USB connector 90. It should be noted that the structures of the driving side connection portion 94 and the USB connection portion 90 are the same as those of the driving side attaching-detaching portion 94 and the USB connection part 90 of the driving unit 1' shown in FIG. 8.

The impeller unit 91, as one of the accessories that are assembled to the beating and washing unit 100, has the same structure of the impeller unit 91 shown in FIG. 8(*a*). As shown in FIG. 10, the impeller unit 91 has a USB terminal 96 inserted into the USB connection portion 90, a motor 12 that is rotationally driven by the electric power supplied from a battery 11 of the beating and washing unit 100 via a USB terminal 96, an impeller 74 that is attached to the output shaft 13 of the motor 12, and an auxiliary side body housing 91*a* that is provided therein with the USB terminal 96, the motor 12 and the impeller 74. The auxiliary side attaching-detaching portion 95 that is elastically deformable in a substantially cylinder and is connected to the beating side attaching-detaching portion 194 of the beating and washing unit 100 is formed at the end portion at the Z1 side of the protruding direction on the auxiliary side body housing 91*a*. A plurality of annular protruding portions (not shown) that are engaged with the protruding portions 94*a* in the vibration direction when they are connected to the driving side connection portions 94 are formed on the inner circumferential surface of the auxiliary side attaching-detaching portion 95. In addition, a plurality of air suction ports 76 capable of supplying air to the rear surface of the impeller 74 are formed in the circumferential direction on the side surface of the auxiliary side body housing 91*a*.

Figure 15:
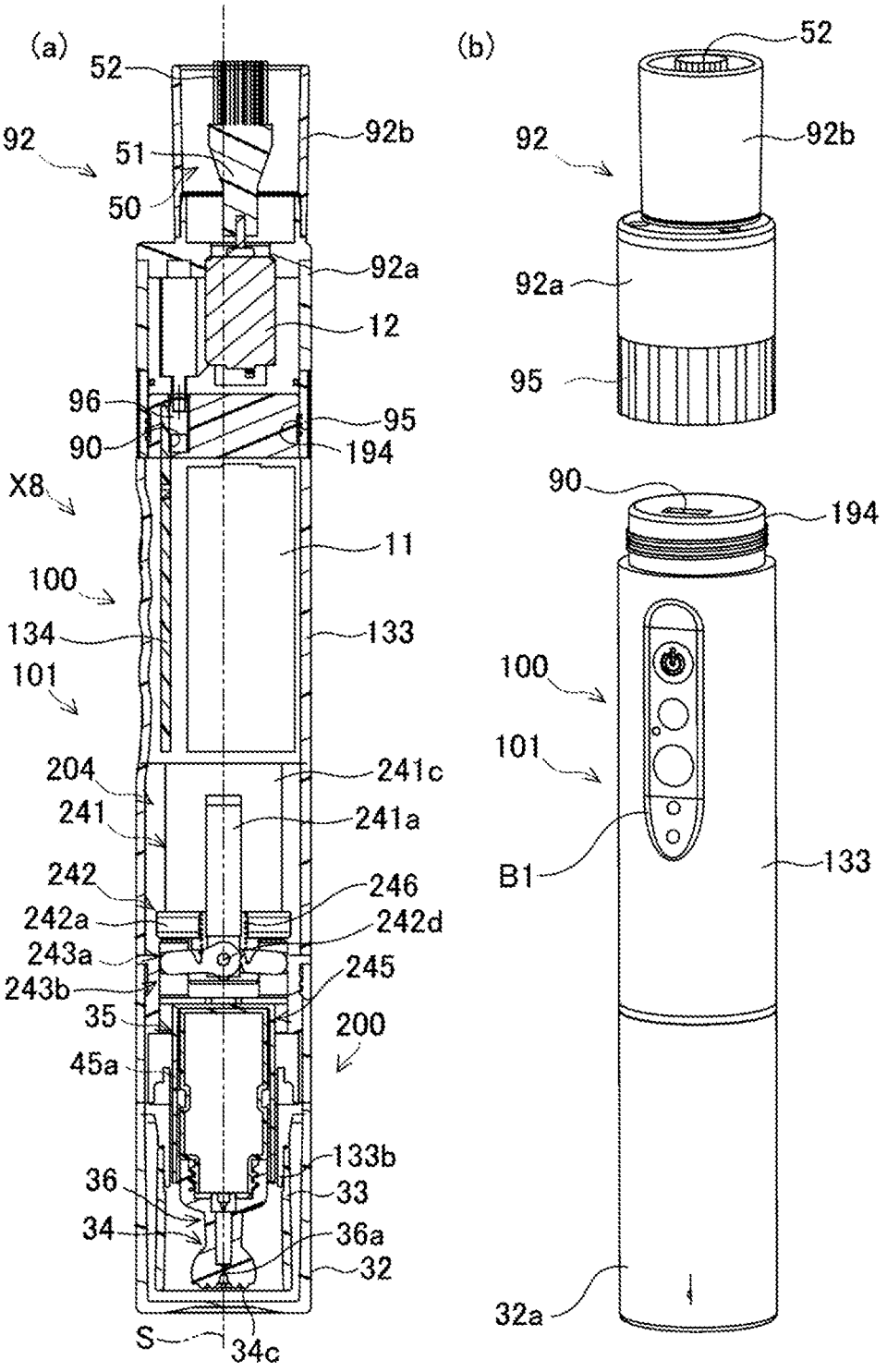
FIG. 15 is a view illustrating the same beating and washing unit in a state in which a brush unit as a brush-type accessory is combined.

In addition, as shown in FIG. 15, the brush unit 92 is attachable to and detachable from the washing unit 100. The brush unit 92 has the same structure as the brush unit 92 shown in FIG. 8(*b*). The brush unit 92 includes a USB terminal 96 inserted into the USB connection unit 90, a motor 12 rotationally driven by the electric power supplied from the battery 11 of the beating and washing unit 100 via the USB terminal 96, a rotary brush 50 mounted on the output shaft 13 of the motor 12, and an auxiliary side body housing 91*a* that is provided therein with a USB terminal 96, a motor 12, and a rotary brush 50. At the end portion of the Z1 side of the protruding direction, the auxiliary side body housing 91*a* is formed with an auxiliary side attaching-detaching portion 95 that is connected to the beating side attaching-detaching portion 194 of the washing and beating unit 100. In addition, a cylindrical cover 92*b* that covers a periphery of the rotary brush 50 is removably mounted at the end portion of the return direction Z2 side of the auxiliary side body housing 91*a*. The rotary brush 50 is set at a position where the top end of the brush portion 52 slightly protrudes from the top end of the cover 92*b*, and is rotated by the rotation of the motor 12. The brush unit 92 provided with such a rotary brush 50 can wash comparatively hard objects, such as sports shoes and wallpaper, and the washing object of this disclosure can be enlarged.

As described above, the beating and washing unit 100, as the washing unit body, that can be driven in a state where the washing mechanism 200 capable of performing at least the washing process is connected and can attach and detach various types of accessories related to washing, has the same structure as that in the first embodiment. By changing the types of the accessories mounted to the beating and washing unit 100, the present disclosure can automatically perform several types of washing treatments related to washing, perform other treatments besides the exchange of the washing manner and the washing related to the washing, and reduce the number of the components by sharing the beating and washing unit 100 so as to realize compactness.

In addition, the washing mechanism 200 includes a head portion 34, which is formed with a beating surface 34*c*, a vibration portion 204, which enables the head portion 34 to vibrate in an axis direction orthogonal to the beating surface 34*c* by means of the driving of an electromagnetic actuator 241, a liquid accommodating portion 35, which is capable of accommodating the liquid, and a water supply path 36, which is formed from the liquid accommodating portion 35 to the head portion 34. The beating and washing unit 100 has a washing mechanism 200, a battery 11, which serves as a power supply portion for supplying power to the vibration portion 204, and a beating side body housing 133, which is provided therein with the washing mechanism 200 and the battery 11 and is formed with a beating side attaching-detaching portion 194 that is connected to the accessory and a USB connection portion 90 capable of supplying the power of the battery 11 to the connection portion of the accessory. Therefore, it can perform various washing-related treatments by replacing the accessory that is electrically connected to the USB connection portion 80 with other types of accessories besides the use of the beating and washing of the driving force applied to the electromagnetic actuator 241 in the linear direction. Besides, the same battery 11 is used for vibrating the head portion and driving the accessory to inhibit an increase in the size of the device.

In addition, the cover member 93 shown in FIG. 9 may be attached via the attaching-detaching portion 94 at the beating and washing unit.

Such a beating and washing unit 100 is combined with the impeller unit 91, the brush unit 92, or the cover member 93 to constitute portable washing units X7, X8, X9. The portable washing units X7 and X8 are configured to drive the electromagnetic actuator 241 or the units 91 and 92 by operating a certain switch owned by the operation portion B1 of the beating and washing unit 100. It should be noted that, it is also possible to use an iron accessory with a built-in heater as an accessory connected to the USB and capable of carrying out washing-related treatment.

The second embodiment of the present disclosure has been described above, but the specific structure of each portion is not limited to the above-described embodiment.

For example, in the above-described embodiment, the motor 12 is provided therein with the accessory, the motor 12 is driven by the electric power supplied from the battery 11 of the beating and washing unit 100 via the USB connection portion 90, and the impeller 74 and the rotary brush 50 are rotated. However, the following structure also can be adopted: the motor 12 is provided in the beating and washing unit 100, and the rotational force of the motor 12 is transmitted to the accessory via the connection portion so as to rotate the impeller 74 and the rotary brush 50.

Figure 16:
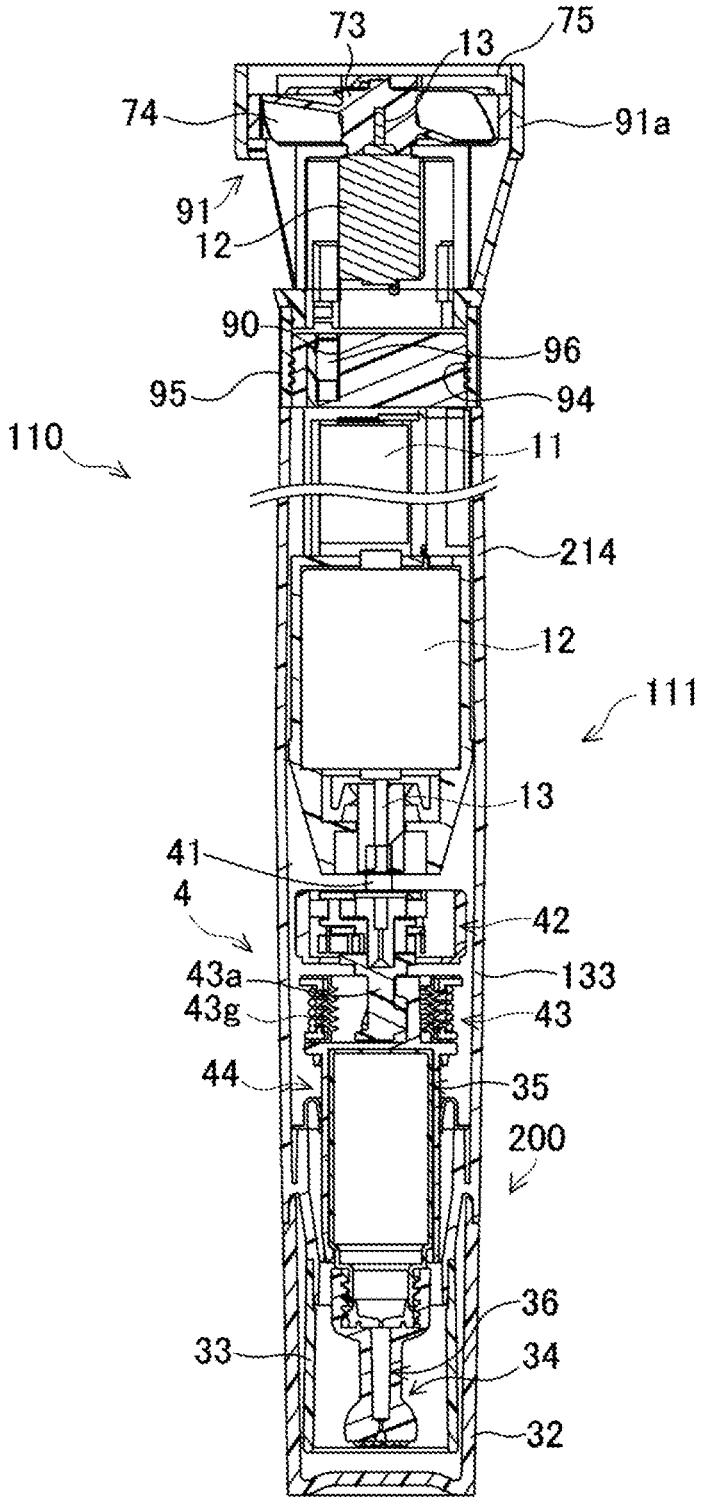
FIG. 16 is a longitudinal sectional view illustrating a modification of the second embodiment.

In addition, the structure in which the head portion 34 is vibrated by the driving of the electromagnetic actuator 241 is not limited, and the structure in which the head portion 34 is vibrated by the rotational force of the motor 12 also can be adopted, i.e. the structure of the beating and washing unit 110 shown in FIG. 16. FIG. 16 is a longitudinal section illustrating a modification of the second embodiment. The device body 111 of the beating and washing unit 110 includes a head portion 34, a liquid accommodating portion 35, a water supply path 36, a vibration portion 4, a battery 11, and a cylindrical beating side body housing 133 that are provided therein with these components. The vibration portion 4 includes a motor 12, an input shaft 41 connected to the output shaft 13 of the motor 12, a planetary gear mechanism 42 as a speed change mechanism, a motion direction conversion mechanism 43 and a piston 44. It should be noted that, the head portion 34, the liquid accommodating part 35, the water supply path 36 and the vibration portion 4 form a washing mechanism 200.

In such a type of beating and washing unit 110, after the rotational force transmitted from the motor 12 is decelerated by the planetary gear mechanism 42, it is converted into a linear movement by the motion direction conversion mechanism 43. Then, the piston 44 and the head portion 34 attached to the piston 44 are integrally vibrated in the vibration direction by the linear motion converted by the motion direction conversion mechanism 43 and the elastic force of the spring 43*g*.

In the above-described embodiment, the operating stroke of the electromagnetic actuator 241 is adjusted by the protective covers 33 and 33*x*. However, the present disclosure is not limited to such a mechanical structure, and the structure of the operating stroke of the electromagnetic actuator may be adjusted by electric controls. Alternatively, the structure that does not interpose the link mechanism 240 and protrudes when the head portion 34 is attracted at the movable core 241 also can be used.

In addition, the materials of the components that form the driving unit 1 are not limited to the materials shown by the shade lines of each figure.

Other structures may be variously modified without departing from the technical spirit of the present disclosure.

What is claimed is:

1. A portable washing unit, comprising: a washing unit body, which is configured to be drivable in a state where a washing mechanism at least capable of executing a washing treatment is connected, and which is attachable and detachable for various accessories capable of performing washing-related treatments;

wherein the washing mechanism is configured as an accessory that is attachable to and detachable from the washing unit body; the washing unit body is a driving unit and comprises:

a motor, which is driven rotationally by means of a power supply;

a driving side body housing, which is provided therein with the motor, and is formed with a driving side attaching-detaching portion that is connectable to the accessories; and a rotation transmission portion, which is capable of transmitting a rotational force of the motor to the accessories;

wherein the portable washing unit is capable of being attached and detached by an accessory having following portions:

a rotation input portion, which is engageable with the rotation transmission portion; a transmission mechanism, which increases or decreases a rotational speed of a rotational force input from the rotation input portion; and an auxiliary side body housing, which is provided therein with the rotation input portion and the transmission mechanism, and is formed with an auxiliary side attaching-detaching portion that is connectable to the driving side attaching-detaching portion.

2. The portable washing unit according to claim 1, wherein the transmission mechanism is a planetary gear mechanism, comprising:

a sun gear that is connected to the rotation input portion;

a plurality of planetary gears that rotate around the sun gear;

a planetary carrier that is connected to a center of each of rotation shafts of the planetary gears; and a ring gear, which is arranged around the planetary carrier.

3. The portable washing unit according to claim 1, wherein the portable washing unit is capable of being attached and detached by a beating-type accessory as the accessory, comprising:

a motion direction conversion mechanism, which converts a rotational motion input by the rotation input portion into a linear motion;

a head portion, which is formed with a beating surface, and vibrates in an axis direction substantially orthogonal to the beating surface via the linear motion converted by the motion direction conversion mechanism;

a liquid accommodating portion for accommodating liquid; and a water supply path, which is formed from the liquid accommodating portion to the head portion;

wherein the motion direction conversion mechanism comprises:

a reference axis, which extends in the axis direction, an inclined surface inclined with respect to the axis direction and extends about the reference axis; and a linear direction moving portion, which is connected to the head portion, and relatively moves on the inclined surface and moves in the axis direction by means of a rotation of the reference axis.

4. The portable washing unit according to claim 1, wherein the portable washing unit is capable of being attached and detached by a brush-type accessory as the accessory, which includes a rotary brush that is connected to the rotation input portion by means of the transmission mechanism.

5. The portable washing unit according to claim 1, wherein the washing mechanism comprises:

a head portion, which is formed with a beating surface, a vibration portion, which enables the head portion to vibrate in an axis direction orthogonal to the beating surface by means of the driving of an electromagnetic actuator or a motor, a liquid accommodating portion for accommodating liquid, and a water supply path, which is formed from the liquid accommodating portion to the head portion, wherein the washing unit body is a beating and washing unit, comprising:

the washing mechanism, a power supply portion, which supplies power to the vibration portion, and a beating side body housing, which is provided therein with the washing mechanism and the power supply portion, and is formed with a beating side attaching-detaching portion that is connectable to the accessories and a connection portion capable of transmitting the power of the power supply portion to the accessories.

6. The portable washing unit according to claim 2, wherein the portable washing unit is capable of being attached and detached by a beating-type accessory as the accessory, comprising:

a motion direction conversion mechanism, which converts a rotational motion input by the rotation input portion into a linear motion;

a head portion, which is formed with a beating surface, and vibrates in an axis direction substantially orthogonal to the beating surface via the linear motion converted by the motion direction conversion mechanism;

a liquid accommodating portion for accommodating liquid; and a water supply path, which is formed from the liquid accommodating portion to the head portion;

wherein the motion direction conversion mechanism comprises:

a reference axis, which extends in the axis direction, an inclined surface inclined with respect to the axis direction and extends about the reference axis; and a linear direction moving portion, which is connected to the head portion, and relatively moves on the inclined surface and moves in the axis direction by means of a rotation of the reference axis.

7. The portable washing unit according to claim 2, wherein the portable washing unit is capable of being attached and detached by a brush-type accessory as the accessory, which includes a rotary brush that is connected to the rotation input portion by means of the transmission mechanism.

* * * * *